US009926813B2

(12) United States Patent
Williams

(10) Patent No.: US 9,926,813 B2
(45) Date of Patent: Mar. 27, 2018

(54) HEAT ENERGY DISTRIBUTION SYSTEMS AND METHODS FOR POWER RECOVERY

(71) Applicant: ElectraTherm, Inc., Reno, NV (US)

(72) Inventor: David C. Williams, Carson City, NV (US)

(73) Assignee: ElectraTherma, Inc., Flowery Branch, GA (US)

( * ) Notice: Subject to any disclaimer, the term of this patent is extended or adjusted under 35 U.S.C. 154(b) by 78 days.

(21) Appl. No.: 14/955,064

(22) Filed: Dec. 1, 2015

(65) Prior Publication Data

US 2016/0084115 A1 Mar. 24, 2016

Related U.S. Application Data

(63) Continuation-in-part of application No. 14/816,045, filed on Aug. 2, 2015, now Pat. No. 9,840,940, which is a continuation of application No. 13/836,442, filed on Mar. 15, 2013, now Pat. No. 9,115,603.

(60) Provisional application No. 61/674,868, filed on Jul. 24, 2012.

(51) Int. Cl.

| | |
|---|---|
| ***F01K 25/08*** | (2006.01) |
| ***F01K 23/06*** | (2006.01) |
| ***F01K 23/00*** | (2006.01) |
| ***F01K 13/00*** | (2006.01) |

(52) U.S. Cl.

CPC ..... *F01K 25/08* (2013.01); *F01K 13/006* (2013.01); *F01K 23/00* (2013.01); *F01K 23/065* (2013.01)

(58) Field of Classification Search

CPC ..... F01K 25/08; F01K 23/00; F01K 23/065; F01K 13/006

USPC ..... 60/39.182, 618, 651, 671

See application file for complete search history.

(56) References Cited

U.S. PATENT DOCUMENTS

| | | | | | |
|---|---|---|---|---|---|
| 4,706,612 | A * | 11/1987 | Moreno | F22B 1/1815 | 122/470 |
| 5,133,298 | A * | 7/1992 | Ahnger | F01K 23/065 | 122/7 R |
| 5,365,730 | A * | 11/1994 | Bruckner | F01K 23/103 | 122/7 B |
| 5,483,797 | A * | 1/1996 | Rigal | F01D 15/10 | 60/641.2 |
| 5,497,624 | A * | 3/1996 | Amir | F01D 15/10 | 60/641.2 |
| 2006/0037352 | A1 * | 2/2006 | Cho | F25B 13/00 | 62/323.3 |
| 2006/0112693 | A1 * | 6/2006 | Sundel | F01K 15/00 | 60/670 |

(Continued)

*Primary Examiner* — Hoang Nguyen

(74) *Attorney, Agent, or Firm* — Patentizer®, LLC; D.C. Williams

(57) ABSTRACT

Systems and methods are provided for the recovery of mechanical power from heat energy sources via multiple heat exchangers and expanders receiving at least a portion of heat energy from a source. The distribution of heat energy from the source may be portioned, distributed, and communicated to the input of each of the heat exchangers so as to permit utilization of up to all available heat energy. In some embodiments, the system receives heat energy from more than one source at one or more temperatures. Mechanical energy from expansion of working fluid in the expanders may be communicated to other devices to perform useful work or operatively coupled to one or more generators to convert the mechanical energy into electrical energy.

21 Claims, 13 Drawing Sheets

(56) References Cited

U.S. PATENT DOCUMENTS

| | | | | |
|---|---|---|---|---|
| 2007/0007771 | A1* | 1/2007 | Biddle | B01D 53/002 290/7 |
| 2012/0036850 | A1* | 2/2012 | Ernst | F01K 23/065 60/615 |
| 2014/0260285 | A1* | 9/2014 | Rechtman | F01K 23/10 60/772 |

* cited by examiner

HEAT ENERGY DISTRIBUTION SYSTEMS AND METHODS FOR POWER RECOVERY

RELATED APPLICATIONS

This application is a Continuation-in-Part and claims domestic benefit of Applicants' pending U.S. Nonprovisional Utility patent application Ser. No. 14/816,045, entitled "Multiple Organic Ranking Cycle Systems and Methods", filed Aug. 2, 2015, which is a Continuation and claims domestic benefit of U.S. Nonprovisional Utility patent application Ser. No. 13/836,442, entitled "Multiple Organic Ranking Cycle Systems and Method" filed on Mar. 15, 2013, now U.S. Pat. No. 9,115,603, which in turn claimed domestic benefit of U.S. Provisional Patent Application 61/674,868, filed on Jul. 24, 2012. All three of said applications (Ser. Nos. 14/816,045, 13/836,442, and 61/674,868) are hereby incorporated by reference in this application for all useful purposes. Further, Applicant also incorporates herein by reference in their entirety and for all useful purposes, co-owned U.S. Nonprovisional Utility patent application Ser. Nos. 13/949,843 and 14/816,046. In the event of inconsistency between anything stated in this specification and anything incorporated by reference in this specification, this specification shall govern.

FIELD OF INVENTION

The present invention relates to apparatus, system, and methods of utilizing organic Rankine cycle ("ORC") systems for the generation of power with multiple expanders and, in some embodiments, a common working fluid.

BACKGROUND

Many physical processes are inherently exothermic, meaning that some energy previously present in another form is converted to heat by the process. While the creation of heat energy may be the desired outcome of such a process, as with a boiler installed to Provide radiant heat to a building using a network of conduits which circulate hot water to radiators or a furnace used for the smelting of metals, in many other instances unwanted heat is produced as a byproduct of the primary process. One such example is an automobile internal combustion engine, which provides motive force as well as significant unwanted heat. Even in those processes in which the generation of heat energy is desired, some degree of residual heat typically escapes or remains that can be managed and/or dissipated. Whether generated intentionally or incidentally, this residual or waste heat represents that portion of the input energy which was not successfully applied to the primary function of the process in question. This wasted energy detracts from the performance, efficiency, and cost effectiveness of the system.

With respect to the internal combustion engine ("ICE"), considerable waste heat energy is generated by the combustion of fuel and the friction of moving parts within the engine. ICE efficiency is generally less than 40%; 60% or more of the engine fuel's energy is therefore converted to waste heat energy that is commonly dissipated to the ICE's surroundings.

Automobiles are usually equipped with extensive systems that transfer the heat energy away from the source locations and distribute that energy throughout a closed-loop recirculating system. This recirculating system usually employs a water-based coolant medium flowing under pressure through jackets within the engine coupled to a radiator across which the imposition of forced air dissipates a portion of the undesired heat energy into the environment. This cooling system is managed to permit the engine to operate at the desired temperature, removing some but not all of the heat energy generated by the engine.

As a secondary function, a portion of the heat energy captured by the engine cooling system may be used to indirectly provide warm air as desired to the passenger compartment for the operator's comfort. This recaptured and re-tasked portion of the waste heat energy generated as a byproduct of the engine's primary function represents one familiar example of the beneficial use of waste heat.

Considerable additional waste heat is expelled from the ICE via the engine exhaust system. The byproducts of the combustion, including gasses containing some particulate matter, exit the engine as a result of the pressure differential between the engine's internal pressure and the lower ambient pressure. Considerable heat is also removed from the system in this process. For most ICE applications, however, it is uncommon to use the heat of the engine exhaust system for a secondary purpose. The temperature of the exhaust flow usually exceeds that of the cooling jacket water. However, the proportion of heat energy removed from the engine and/or available for conversion to other purposes via may not be similarly distributed. For example, the total available heat energy in the jacket water may be less than, equal to, or greater than the total heat energy contained in the exhaust gas flow.

In addition to the cooling of ICEs, jacket water cooling systems have been utilized in a number of other industrial applications, including but not limited to compressor heads or other components in which an increase in pressure, internal friction, or other physical phenomena causes an increase in temperature that must be removed from the system for proper operation. In such systems, exhaust gasses may simultaneously be generated by the same device or by an interconnected device or system, such as the source of power for a gas compressor system. In the case of systems that capture radiated energy including but not limited to solar-based systems, jacket water may be used to cool the apparatus. In some cases, this jacket cooling may be in addition to any primary flow of media inside the system that constitutes the primary conversion function of the system, and the heat energy captured by the secondary cooling system may be considered waste heat energy if it is of no use to the primary solar-based system.

Characteristics of the heat sources that affect quality may include but are not limited to its temperature (sufficiency and stability), form (gaseous, liquid, radiant, etc.), the presence of corrosive elements associated with the heat source, accessibility for use, and the duty cycle of availability. Waste heat energy sources are classified by grade according to these characteristics. Prior art ORC systems prefer higher grade sources of heat that are readily accessible, of generally high and stable temperature, are free of contaminants, and are available without interruption. Lower grade sources of heat, particularly those at lower temperatures, are not as desirable and have not been fully utilized by the prior art.

Large internal combustion engines, as another example, are widely used in heavy industry in numerous applications. For example, General Electric's Jenbacher gas engine division produces a full range of engines with output power capabilities ranging from 250 kW to over 8,000 kW. By comparison, a typical mid-class automobile engine produces about 150 kW of usable output power. The Jenbacher engines may be powered by a variety of fuels, including but not limited to diesel, gasoline, natural gas, biogas, and other combustible gasses including but not limited to those produced from landfills, sewage, and coal mines. These engines are frequently employed to drive electric power generators, thereby converting the mechanical energy produced from the energy of combustion into electrical energy.

In operation, these Jenbacher engines generate tremendous amounts of waste heat energy that has historically been dissipated into the environment. In the case of the combined Jenbacher model J316 engine and generator system with a rated electric power output of approximately 835 kW, approximately 460 kW of heat energy is lost (dissipated) in the exhaust gas at an approximate temperature of 950° F. and approximately another 570 kW is lost in the internal cooling system with a typical jacket water coolant temperature of approximately 200° F. Of that 570 kW, approximately 463 kW is suitable for waste heat recovery at sufficient temperature with the remainder of such low grade as to not be practicable for direct conversion. From this data, less than half of the system's energy output is in the desired form (in this case, electric power output from the system generator). In many prior art systems, a substantial portion of the input energy converted to heat will be lost The heat from exhaust gas generally escapes into the atmosphere, and the recirculating jacket water is cooled by an outboard apparatus (such as by large external condensing radiators driven by forced air sources), which consume additional electric power to function and further reduce the efficiency of the system.

Additionally, the dissipation of this waste heat energy into the environment can have deleterious effects. Localized heating may adversely affect local fauna and flora and can require additional power, either generated locally or purchased commercially, to provide additional or specialized cooling. Further, the noise generated by forced air cooling of the jacket water heat radiators can have undesirable secondary effects.

Waste heat energy systems employing the organic Rankine cycle (ORC) system have been developed and employed to recapture waste heat from sources such as the Jenbacher 312 and 316 combustion engines. One typical prior art ORC system for electric power generation from waste heat is depicted in FIG. 1. Heat exchanger 101 receives a flow of a heat exchange medium in a closed loop system heated by energy from a large internal combustion engine at port 106.

For example, this heat energy may be directly supplied from the combustion engine via the jacket water heated when cooling the combustion engine, or it may be coupled to the ORC system via an intermediate heat exchanger system installed proximate to the source of exhaust gas of one or more combustion engines. In either event, heated matter from the combustion engine or heat exchanger is pumped to port 106 or its dedicated equivalent. The heated matter flows through heat exchanger 101 and exits at port 107 after transferring a portion of its latent heat energy to the separate but thermally coupled closed loop ORC system which typically employs an organic refrigerant as a working fluid. Under pressure from the system pump 105, the heated working fluid, predominantly in a gaseous state, is applied to the input port of expander 102, which may be a positive displacement machine of various configurations, including but not limited to a twin screw expander or a turbine. Here, the heated and pressurized working fluid is allowed to expand within the device, and such expansion produces rotational kinetic energy that is operatively coupled to drive electrical generator 103 and produce electric power which then may be delivered to a local, isolated power grid or the commercial power grid. The expanded working fluid at the output port of the expander, which typically is a mixture of liquid and gaseous working fluid, is then delivered to condenser subsystem 104 where it is cooled until it has returned to a sufficiently liquid state for repressurization by system pump 105.

The condenser subsystem sometimes includes an array of air-cooled radiators or another system of equivalent performance through which the working fluid is circulated until it reaches the desired temperature and state, at which point it is applied to the input of system pump 105. System pump 105 provides the motive force to pressurize the entire system and supply the liquid working fluid to heat exchanger 101, where it once again is heated by the energy supplied by the combustion engine waste heat and experiences a phase change to its gaseous state as the organic Rankine cycle repeats. The presence of working fluid throughout the closed loop system ensures that the process is continuous as long as sufficient heat energy is present at input port 106 to provide the requisite energy to heat the working fluid to the necessary temperature. See, for example, Langson U.S. Pat. No. 7,637,108 ("Power Compounder") which is hereby incorporated by reference.

As a result of the transfer of waste heat energy from the combustion engine to the ORC system, these types of prior art ORC systems serve two functions. They convert this waste heat energy, which would otherwise be lost, into productive power; and they simultaneously provide a beneficial, and sometimes a necessary, cooling or condensation function for the combustion engine. In turn, the ORC system's shaft output power has been used in a variety of ways, such as to drive an electric power generator or to provide mechanical power to the combustion engine, a pump, or some other mechanical apparatus.

ORC systems can extract as much useful heat energy as they can utilize from one or more waste heat sources (often referred to as the "prime mover"), but owing to various physical limitations they cannot convert all available waste heat to mechanical or electric power via the expansion process discussed above. Similar in some respects to the cooling requirements of the prime mover, the ORC system requires post-expansion cooling (condensation) of its working fluid prior to repressurization of the working fluid by the system pump and delivery of the working fluid to the heat exchanger. The heat energy lost in this condensation process, however, represents wasted energy which detracts from the overall efficiency of the system.

Prior art ORC systems capture a portion of the waste heat energy from either the exhaust gas flow or jacket cooling water, or a combination of both, from a prime mover but must discard a portion of the waste heat energy that might otherwise be captured and converted into useful mechanical and/or electrical energy. Some heat energy is distributed within the internal processes of the prior ORC systems, and this heat energy must be recaptured or it will be lost, thereby decreasing efficiency. For example, the prior art includes systems that utilize superheated fluids, including water, and the recuperation process to increase efficiency (see, for example, Kaplan, US 2010/0071368). This approach recaptures heat energy that would otherwise be lost in the post-expansion fluid during condensation and redirects that energy back to the energy transfer components (vaporizers), which heat the system's working fluid.

The prior art also includes, for example, the use of multiple expanders with multiple heat sources (Biederman, US2010/0263380), cascaded expanders (Stinger, U.S. Pat. No. 6,857,268), and other ORC system configurations with multiple working fluids (Ast, 2010/0242476). These types of systems, however, each add structure and processing to the basic ORC cycle in a fashion that consumes or wastes heat energy that could otherwise be utilized in an ORC cycle. These additional structures also add cost to the systems.

Exacerbating the situation is the fact that these and other prior art systems require the use of high grade waste heat. For example, the expanders typically used in these systems require superheated (other than wet) working fluid. As a result, their input temperature requirements are such that high temperature waste heat is required to properly drive the systems.

Further, these and other references teach the use of additional components, including intermediate heat exchangers to transfer heat energy from one portion of the system to another, including between ORC processes that use separate working fluids of possibly different compositions. Such intermediate components add cost and cause the system to operate at reduced efficiency compared to what can be attained without them.

Further, the use of cascaded heat transfer subsystems necessary to accommodate multiple working fluids decrease the exergy, or the heat energy, recovered from the prime mover that is available for use by the ORC. These types of heat transfer subsystems also increase the cost, complexity, and size of the ORC waste heat recovery system while decreasing reliability and requiring greater maintenance.

Some prior art combined prime mover/ORC engine applications have utilized heat generated by the ORC condensation process in a conventional ORC system condenser while simultaneously providing power (electrical and/or mechanical) for various purposes. Combined heat and power ("CHP") ORC systems have typically fulfilled a secondary purpose by using a portion of the heat energy from the prime mover and/or heat energy remaining in the post-expansion working fluid. FIG. 5A depicts a prior art ORC system including combustion engine heat energy output port 501 and condenser heat energy output port 502.

In one prior art ORC application, residual heat extracted from a dedicated ORC condenser during the cooling of post-expansion ORC working fluid at condenser heat energy output port 502 is used to provide domestic hot water, radiant heating, or both. This process uses a conventional ORC condenser system well known in the art. The energy flow of one such application is depicted in the block diagram of FIG. 5A. In this application, a heat generating engine 601 is operatively coupled to electric generator 602 and provides waste heat energy 603 to the ORC system 604. In turn, the ORC system 604 is operatively coupled to drive electric generator 605. Heat energy from the prime mover 601 is delivered to heat energy output port 501 and, in some prior art systems, is extracted to a first heat energy input port 606 (such as for radiant heating); in addition, heat energy from the ORC condenser is delivered to a second heat energy input port 607 (such as for hot water heating). In those ORC systems known by the Applicant, utilization of residual heat from the post-expansion working fluid is intentionally extracted from the system but is not utilized for further system optimization of the prime mover or, for example, for heating a production material such as microorganisms to generate biofuel.

As noted above, screw and twin screw expanders have long been utilized in many applications in the prior art. Certain of these types of expanders have long been capable of operating with wet (i.e., non-superheated) working fluid. As a result, these types of expanders have also long been utilized with heat sources and working fluid temperatures well below the comparable temperatures provided by high temperature heat sources and the superheated working fluid developed in the associated ORC and its expander as a result.

BRIEF SUMMARY OF SOME ASPECTS OF DISCLOSURE

Applicants have invented apparatus, systems and methods that generate mechanical and/or electrical power from one or more waste heat flows using a system of multiple heat exchangers and working fluid expanders. In some embodiments, the expanders operate at multiple temperatures and/or multiple pressures ("MP") and utilize a common working fluid. In other embodiments, the expanders each operate with separate working fluid circuits.

In certain embodiments of the system, two expanders are utilized. This two-expander MP ORC system is a dual-pressure, or two-pressure ("2P"), configuration. In certain embodiments of a 2P system, one expander operates in a high-pressure ("HP") ORC cycle and the second expander operates in a low-pressure ("LP") ORC cycle. Both ORC cycles utilize a common working fluid comprising an organic refrigerant or other suitable substance.

In some applications, multiple heat sources can provide input energy and may originate from a single prime mover, such as, for example, the jacket cooling water and exhaust flow from an internal combustion engine. The ORC heat input may also be provided by two or more prime movers, such as multiple ICEs and/or any other suitable sources.

In certain embodiments, one or more heat sources provide heat energy to more than one heat exchanger in working fluid communication with one or more expanders. Heat from one or more particular source(s) may be apportioned among and provided to more than one heat exchanger to optimize overall system performance, including but not limited to generating maximum output power (mechanical or electrical), consuming all available waste heat available from one or more source(s), balancing the heat distribution to or the output power delivered by any or all of said expanders, and the like. Attainment of any useful purpose achieved by distribution of heat energy from one or more source(s) is envisioned by this disclosure.

In some applications, differing heat sources can supply heat energy to a closed loop ORC system including multiple ORC's utilizing a wet working fluid, including as the input to and through one or more expanders in the closed loop system. In some systems, this can allow use of the closed loop ORC system to recover energy from one or more heat sources that will not superheat the ORC working fluid in one or more expanders. In turn, this allows the ORC to avoid use of at least one superheater or recuperator, with the associated cost and heat energy loss of such systems.

In some embodiments, at least one of the expanders is screw expander capable of being driven by wet working fluid. Some instances of the screw expander constitute a twin screw expander. In some instances, the closed loop ORC system includes at least two ORC's, each of which have a screw expander operable with wet working fluid. In some of these embodiments, the screw expander is a twin screw expander.

In some embodiments, the MP ORC system accepts waste heat energy at different temperatures. In certain embodiments, the MP ORC system utilizes a single closed-loop cycle of organic refrigerant flowing through up to all expanders in the system. In some instances, the distribution of heat energy to each of the expanders is allocated and controlled to utilize more, and, when desired, up to and including all available heat energy and increase or maximize the power output of the waste energy recovery process. One or more of the expanders may be operatively coupled to one or more generators that convert the mechanical energy of the expansion process into electrical energy.

In some embodiments, heat energy may be coupled from one heat exchanger to one expander on an exclusive basis. In some embodiments, one heat exchanger my provide heat energy to more than one expander via a common working fluid or via separate working fluids flows within the same heat exchanger. In some embodiments, more than one heat exchanger may provide heat energy to a particular expander, either via a common working fluid passing through said more than one heat exchanger(s) sequentially or via separate working fluid flows combined at or prior to the working fluid inlet of said particular expander. In some embodiments, more than one heat exchanger may provide heat energy to more than one expander via a common working fluid flow or via separate working flows advantageously combined at or prior to the inlet(s) of said expander(s).

The prime mover of some embodiments can be any system, apparatus, or combination of apparatus that converts some or all of its input energy into heat energy or waste heat energy in a form and quantity sufficient for use by one or more MP ORC system(s). In some embodiments, the principal or only purpose of the prime mover can be to generate heat for the MP ORC system(s). Any heat energy sources co-located, compatible for use with, and utilizable by one or more MP ORC system(s), fall within the scope of the term "waste heat" for the purpose of this application.

In some systems, a prime mover can generate and deliver mechanical power to an electric or other power generator in addition to providing waste heat energy for the MP ORC system(s). In certain embodiments, a prime mover can simultaneously generate more than one form of waste heat, such as, for example, cooling water, hot exhaust gas, or radiated heat.

In some embodiments, a suitable prime mover may be a gas compression system in which one or both of the compressor and a system that cools a compressed gas line or reservoir may serve as sources of waste heat energy for the MP ORC.

In some embodiments, a suitable prime mover may be an air compression system such as a turbocharger for a large industrial engine. Heat from the charge air flow may be extracted via one or more heat exchangers and transferred to working fluid therein for expansion in one or more ORC expanders. Further, additional heat energy may be extracted from any compressor cooling system, such as a forced-air cooling system or an oil, refrigerant, or other recirculating liquid cooling system, with said extracted heat energy provided to one or more ORC systems to heat working fluid for expansion and energy recovery.

In some systems, the waste heat recovery system(s) include one or more power generating system, which can be MP ORC system(s), and one or more power receiving components, which can be but are not limited to electric power generator(s), prime mover(s), pump(s), combustion engine(s), fan(s), turbine(s), compressor(s), and the like. The rotational mechanical power generated by the power generating system(s) can also be delivered to the power receiving components.

Waste heat energy may be captured and provided to the MP ORC system in any practicable manner, either directly or via one or more intermediate heat exchanger systems.

In some embodiments, the prime mover can include one or more devices used in an industrial application, such as, for example, electrical power generation, industrial manufacturing, gas compression, inlet air compression for turbochargers, gas or fluid pumping, and the like.

In some embodiments, one or more prime movers provide waste heat energy to one or more MP ORC systems, each of which include multiple ORC cycle operating at different pressures, different temperatures, or different temperatures and pressures. The heat energy is transferred from the prime mover(s) to the MP ORC system(s) via one or more heat exchanger subsystem(s). The heat exchanger subsystem(s) can utilize any practicable method of heat transfer and/or media, such as, for example, water, oil, refrigerant, air, radiation, convection, direct contact, and the like.

In certain embodiments, a single heat exchanger subsystem may be employed for an MP ORC system, a prime mover, a source of heat energy from each prime mover, or for more than one MP ORC system, prime mover, or heat energy source. Such heat exchanger subsystems can have separate inlets and separate outlets for the energy source(s) or a single inlet and/or outlet may be utilized for more than one source.

In certain embodiments, one or more MP ORC systems has a closed loop cycle to prevent intermixture of working fluid between MP ORC systems. In some instances, one more prime movers operates with a separate closed loop jacket water cooling system to prevent any intermixture of jacket water between the prime mover(s) and another system such as an MP ORC system.

In some embodiments, an exhaust gas heat recovery subsystem may be employed to recover waste heat energy from more than one prime mover and convey such heat energy to more than one associated MP ORC system. In some embodiments, a heat recovery subsystem may receive heat energy input from one or more sources and/or provide heat energy to more than one MP ORC system.

In some embodiments, an internal combustion engine generating sufficient waste heat energy in the form of jacket cooling water and exhaust gas provides the energy to separate heat exchanger subsystems coupled to a 2P ORC system. The heat energy can be applied in prescribed amounts to one or both of the two ORC cycles within the 2P ORC system, with the two ORC cycles operating at different pressures. In some such embodiments, up to all of the available waste heat energy may be utilized to the fullest extent possible for conversion to mechanical energy by an expander and/or, by operative connection to a generator, into electrical energy.

In some embodiments, the heat energy from more than one prime mover may be coupled to a single MP ORC system. This can be particularly advantageous when a plurality of prime movers are co-located and the available heat energy from a single ICE is insufficient to fully utilize the energy conversion capability of a single MP ORC system.

In some systems, the heat energy from more than one prime mover may be coupled to a plurality of MP ORC systems.

In some applications, one or more MP ORC systems constitute the entire jacket water cooling system for the prime mover(s). In such cases, the MP ORC systems can replace alternative prime mover cooling systems, which consume, rather than generate, power during operation and therefore usually have a significant cost of operation in addition to their cost of installation. Such power-consuming, dedicated prime mover cooling systems can have a significantly larger footprint than an ORC system, and therefore they may require additional physical space at the generation facility. They may also generate noise and unwanted environmental heat pollution as a consequence of operation. Employing one or more ORC systems in lieu of power consuming dedicated prime mover cooling systems, which are net consumers of power under such circumstances, can be economically, physically, and/or environmentally beneficial.

In some embodiments, the MP ORC system(s) provide a portion of the cooling system for the prime mover(s) and operate in conjunction with additional cooling systems. Electric or other power generated by some MP ORC systems can be applied to the operation of said additional cooling systems for the prime mover as well as provide electric or other power for other purposes at the site or elsewhere. This can be particularly advantageous if, for example, the prime mover is configured to solely provide mechanical power output and a commercial source of electric power is not readily available.

In some embodiments, the residual heat energy remaining in the MP ORC system after all recoverable energy has been converted into mechanical and/or electrical energy may be employed for a further purpose, such as, for example, building heating, domestic and/or industrial hot water applications, the heating of bacterial cultures for anaerobic digestion of biodegradable waste materials, or other purpose(s).

In certain systems, the MP ORC system utilizes all or nearly all of the available and recoverable waste heat energy available from the prime mover(s) and converts that waste heat energy into mechanical and/or electrical energy.

Instances of the MP ORC configuration can provide the opportunity to couple additional heat energy input to the system so that higher sustained power output may be realized while simultaneously increasing system efficiency and/or fully utilizing all available waste heat energy.

One advantage of certain disclosed MP ORC systems are their ability to utilize waste heat energy from multiple sources, such as, for example (meaning herein, without limitation), from sources of different temperatures and of differing quality.

The flexibility afforded by the use of certain multiple ORC cycles and some methods of calculating the required distribution of heat energy from multiple sources of varying grades between the ORC cycles can permit some systems to be optimized for a specific application within a wide range of possibilities.

An additional advantage of some disclosed MP ORC systems is that they can permit up to all or nearly all of the available and recoverable waste heat energy available from one or more sources to be utilized to a greater and, in some embodiments, the fullest extent possible within the physical limitations of the ORC process described in detail below. By more fully utilizing more or up to all available and recoverable waste heat energy, the MP ORC system provides improved, and in some instances, the greatest possible conversion efficiency and economic return.

An additional advantage of certain MP ORC systems is that, by more fully utilizing the waste heat energy from one or more sources, such as for example but not limited to the jacket cooling water from an ICE, the need for additional cooling systems can be significantly reduced or even eliminated. In the prior art known to the applicants, it has been necessary to dissipate remaining available heat energy from sources that cannot be fully utilized by the ORC; that is, available heat energy not captured and converted by the ORC system has been be cooled via secondary means, such as, for example, via use of radiators. These systems not only require considerable space and expense, but they typically consume significant electric power to drive the fans that provide the necessary cooling. As at least some MP ORC systems can fully extract all or nearly all available and recoverable heat energy from its sources, such systems can provide the dual function of generating electric power while obviating the need to consume, e.g., electric power as required in the present art to provide the necessary cooling.

The foregoing is a brief summary of only some of the novel features, problem solutions, and advantages variously provided by the various embodiments. It is to be understood that the scope of an issued claim is to be determined by the claim as issued and not by whether the claim addresses an issue noted in the Background or provide a feature, solution, or advantage set forth in this Brief Summary. Further, there are other novel features, solutions, and advantages disclosed in this specification; they will become apparent as this specification proceeds.

BRIEF DESCRIPTION OF THE DRAWINGS

Without limiting the invention to the features and embodiments depicted, certain aspects this disclosure, including the preferred embodiment, are described in association with the appended figures in which.

DETAILED DESCRIPTION

Figure 2:
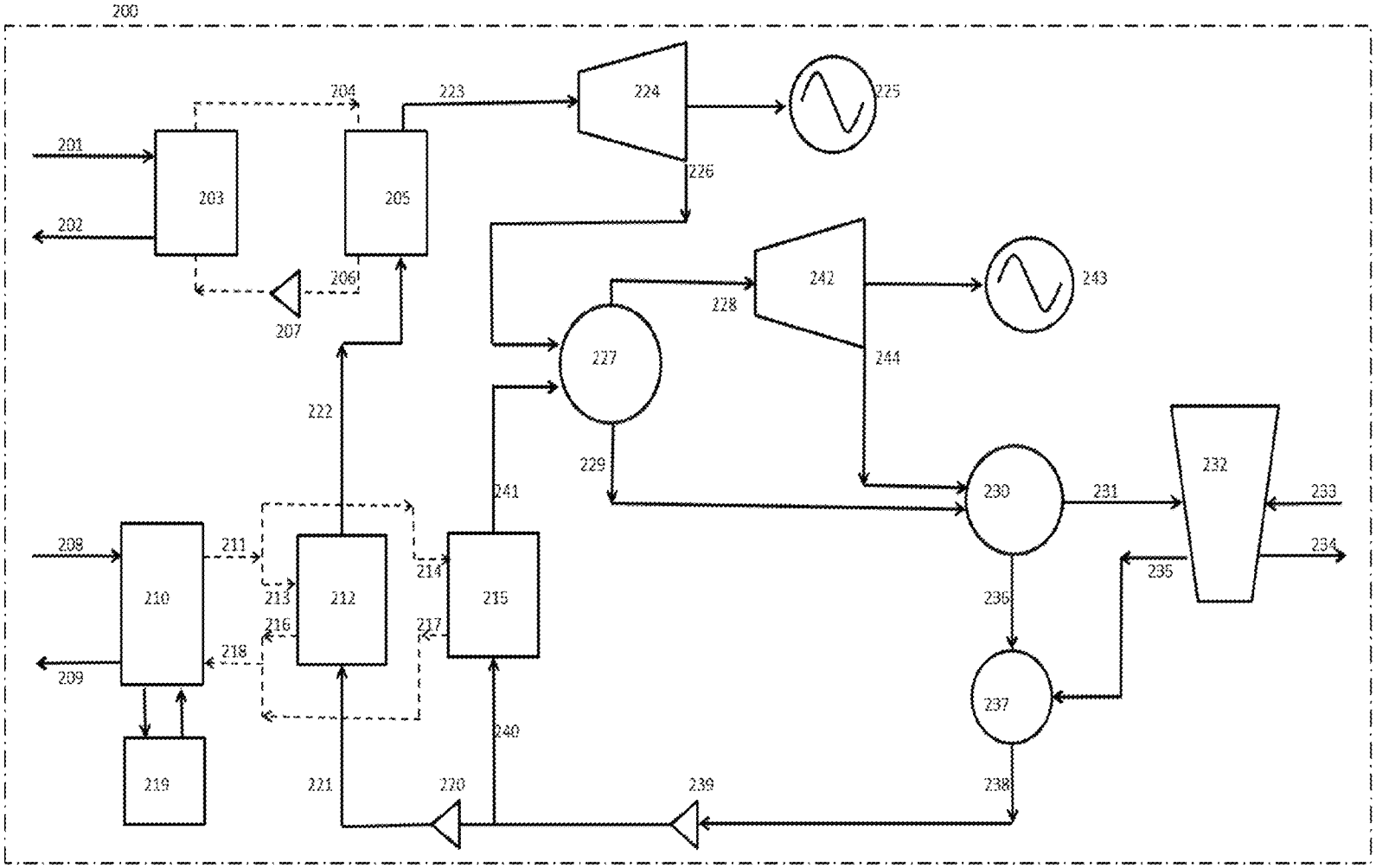
FIG. 2 is a block diagram of an embodiment of a 2P multi-pressure ORC system with two expanders.

FIG. 2 depicts a multi-pressure ORC system 200 that utilizes two expanders 224, 242 operating at different pressures. This configuration is an embodiment of a dual-pressure or 2P ORC system.

By way of example and not limitation, this embodiment as described is suitable for use with a J316 ICE engine, as specified and manufactured by the Jenbacher Gas Engine division of General Electric Energy, as the prime mover. Those skilled in the art will recognize that different configurations suitable for other applications are clearly envisioned by this invention, such as the use of prime movers including but not limited to ICEs with power outputs ranging from 250 kW to 8,000 kW. In this embodiment, the J316 serves a single prime mover for the 2P ORC system and supplies heat energy from both exhaust gas flow and jacket cooling water.

Heat energy contained in the exhaust gas flow of the prime mover is supplied at 201 to a thermal oil heat transfer subsystem 203 operatively coupled to first high pressure cycle evaporator 205 via a recirculating flow of oil through conduits 204 and 206. Thermal oil heat transfer subsystem 203 may include an exhaust gas heat exchanger such as those manufactured and sold by E.J. Bowman Ltd. of Birmingham, UK. The oil flow through this intermediate heat transfer system is facilitated by a pump 207. Following extraction of up to all of the useful heat energy from the exhaust gas flow, at least to the degree of a desired working fluid temperature increase through the first high pressure cycle evaporator 205, the reduced temperature exhaust gas exits the thermal oil heater subsystem at 202. The first high pressure cycle evaporator 205 may be a brazed plate heat exchanger such as those supplied by GEA Heat Exchangers GmbH of Bochum, Germany.

In this particular embodiment, the temperature of the exhaust gas at 201 is approximately 950° F. and approximately 350° F. at 202. Extracting additional heat energy from the exhaust gas flow would further reduce the temperature at 202, resulting in the condensation and precipitation of certain corrosive agents from the exhaust gas flow that would damage and adversely affect the performance of the system. So-called "bad actor" corrosive agents include residual and largely non-combustible elements and compounds present in the fuel supplied to the prime mover ICE, particularly those found in biogas produced by decomposition of unknown biological and/or other materials. Sulfur is one particularly notorious bad actor, as it may combine to form hydrogen sulfide gas ($H_2S$) or sulfuric acid ($H_2SO_4$). Both are extremely corrosive and toxic and, if allowed to precipitate within the exhaust gas heat exchanger portion of thermal oil heat transfer subsystem 203, would significantly degrade the performance and reduce the operating life of that subsystem. For optimum system performance, it is desirable that these bad actors remain in the vapor state until expelled from the system's exhaust stack.

In one embodiment, the working fluid may be heated by any different form of intermediate heat transfer system. In one embodiment, the working fluid may be heated directly by the exhaust gas without the use of an intermediate heat transfer system such as thermal oil heat transfer subsystem 203. For example, the working fluid may be directed through conduits and manifolds directly exposed to the high temperature exhaust gasses, thereby heating the working fluid directly without the use of intermediate media such as oil.

In one embodiment, the temperature of working fluid as heated by high pressure cycle evaporator 205 does not exceed the saturation temperature of the working fluid vapor. One common type of working fluid, (Genetron R-245fa), has a saturation temperature of approximately 280° F. at a pressure of 390 psia. High pressure cycle evaporator 205, such as the GBS series of brazed plate heat exchangers manufactured and sold by GEA Heat Exchangers GmbH of Bochum, Germany, can be used in this embodiment to heat this particular working fluid to 280° F. at a pressure of 390 psia. As the amount of heat energy transferred to the working fluid increases to a point, the enthalpy of the working fluid will increase and the proportion of vaporized working fluid to liquid working fluid will increase, but the temperature will not exceed 280° F. at a pressure of 390 psia. If the system pressure is increased without adding any additional heat energy, the working fluid temperature will increase but the fluid maintains a constant enthalpy. Similarly, if the system pressure is decreased adiabatically, the working fluid temperature will decrease but the fluid will maintain a constant enthalpy. Were a superheater to be employed to transfer sufficient additional heat energy to the working fluid, the enthalpy of the heated working fluid would continue to increase until the working fluid in this example would eventually be completely vaporized and its temperature would then begin to exceed 280° F. at the pressure of 390 psia. This process of increasing the enthalpy of the working fluid to a point such that the temperature of the heated working fluid exceeds its temperature of vaporization at the operative pressure is referred to as superheating. However, the 2P ORC system of this embodiment utilizes a wet working fluid throughout and does not require or utilize a superheater or superheated working fluid. Superheating typically requires recuperation to prevent loss of heat energy in the post-expansion working fluid and the elimination of superheated working fluid and the recuperation process represents an improvement over the prior art. The proportion of liquid state working fluid to vapor state working fluid at any point in the system may vary from completely liquid to completely vaporized depending upon the enthalpy and pressure of the working fluid at that point.

Heat energy contained in the jacket cooling water from the prime mover is supplied at inlet 208 to a jacket water distribution subsystem 210, which consists of a series flow control valves such as the D08 series of proportional control valves available from Continental Hydraulics of Savage, Minn. Under the control of microprocessor-based control subsystem 219 such as the DirectLogic series of programmable logic controllers (PLCs) available from Automation Direct of Cumming, Ga., the control valves in the jacket water distribution system outlet 211 provide the requisite amount of heated jacket water to the high pressure cycle preheater 212 at inlet 213 and to the low pressure cycle preheater and evaporator 215 at inlet 214. These preheaters and evaporators may also be those such as the GBS series of brazed plate heat exchangers manufactured and sold by GEA Heat Exchangers GmbH of Bochum. Germany.

In one embodiment, the low pressure cycle preheater and evaporator 215 described above is a single unit. In one embodiment, the low pressure cycle preheater and evaporator 215 comprises two separate units of similar origin and functionality. In one embodiment, one or more separate preheaters and/or evaporators may be used. All of the heated jacket water received at inlet 208 is provided to either inlet 213 or inlet 214. After passing through the high pressure cycle preheater 212 and the low pressure cycle preheater and evaporator 215, the reduced-temperature jacket water is returned via outlets 216 and 217, respectively, to inlet 218 of jacket water distribution subsystem 210 where it is returned to the prime mover via outlet 209 for recirculation. In this embodiment, the temperature of the jacket water at outlet 211 is approximately 195° F. Subsequent to the transfer of heat within the high pressure cycle evaporator 205 and low pressure cycle preheater and evaporator 215, the temperature of the jacket water at inlet 218 is approximately 160° F. The temperature of the jacket water returned to the prime mover at outlet 209 is maintained within the manufacturer's specified range for proper operation of the prime mover. For the Jenbacher 316 ICE, this range is nominally 50° C. (122° F.) to 90° C. (194° F.).

In one embodiment, high pressure cycle preheater 212 heats the working fluid to the saturation temperature of the working fluid at the operating pressure. In one embodiment, high pressure cycle preheater 212 heats the working fluid to a temperature less than the saturation temperature of the working fluid. For example, high pressure cycle preheater 212 may heat the working fluid to a temperature of 280° F. at a pressure of 390 psia or any other temperature between the working fluid temperature at inlet 221 (nominally 90° F.) and 280° F. However, the high pressure cycle preheater 212 can only heat the working fluid to a maximum temperature that, owing to limitations of the heat transfer apparatus and laws of thermodynamics, approaches but may never exceed the maximum temperature of the input flow of heated jacket water at inlet 213, which in the preferred embodiment is approximately 195° F. A further discussion of the difference between the temperature of input heat energy and the maximum temperature of the heated working fluid output (known as the "pinch") is provided below. Heating the working fluid to a greater temperature will necessitate a higher grade of waste heat energy input to jacket water distribution subsystem 210.

Control subsystem 219 is also operatively coupled to a plurality of sensors, control valves, and other control and monitoring devices throughout the 2P ORC system. To maintain clarity of the Figures, these operative couplings are not depicted in FIG. 2 but are well known to those of ordinary skill in the art. The correct allocation of jacket water heat energy is essential for optimization of 2P ORC operation, and the method for determining and accomplishing this distribution as implemented by control subsystem 219 is described more fully below.

Figure 4:
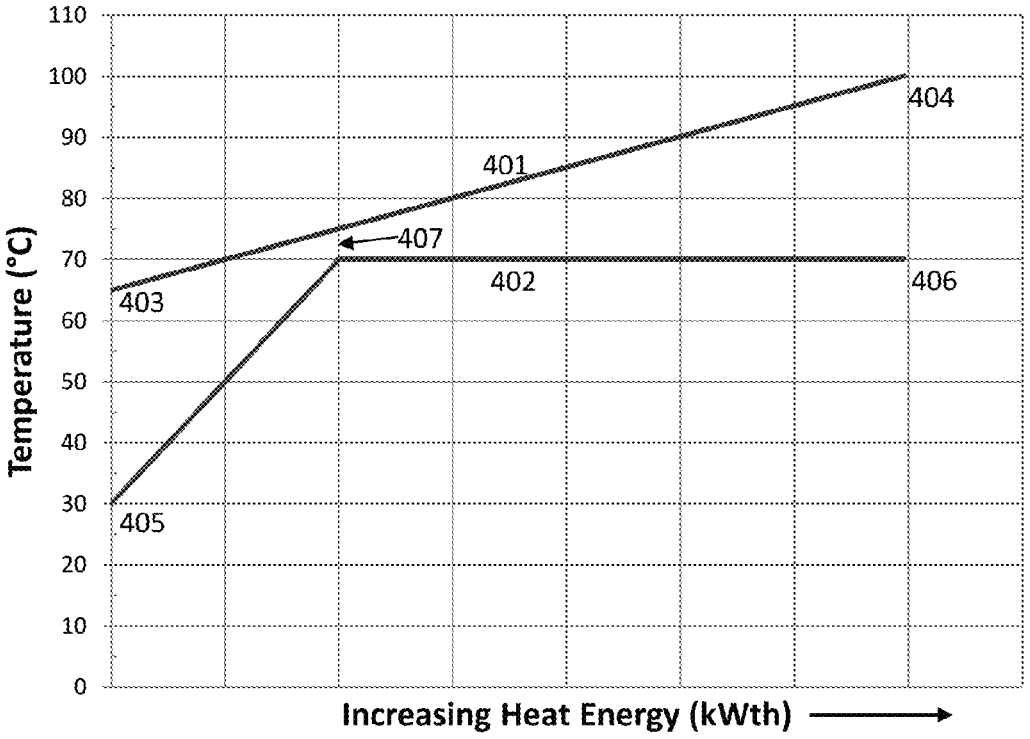
FIG. 4 depicts the temperature versus heat energy of the source and a hypothetical working fluid during the heat energy transfer process from the source to the ORC working fluid in the low pressure cycle of a 2P multi-pressure ORC system.

In one embodiment, 2P ORC system 200 utilizes a single closed loop of working fluid typically comprising a mixture of lubrication oil and organic refrigerant suitable for heating and expansion within the range of temperatures provided by the prime mover. By way of example and not limitation, the refrigerant may be R-245fa, commercially known as Genetron® and manufactured by Honeywell. The performance of the working fluid described in association with FIG. 4 is similar but not identical to R-245fa. However, any organic refrigerant including but not limited to R123, R134A, R22, and the like as well as any other suitable hydrocarbons or other fluids may be employed in other embodiments. In some embodiments, a small percentage of lubrication oil by volume is mixed with the refrigerant for lubrication purposes.

The working fluid is pressurized by centrifugal fluid pumps and variable frequency drive ("VFD") motors 220 and 239 collectively referred to as VFD pumps, operatively monitored and controlled by control subsystem 219. In one embodiment, a single VFD pump may be utilized with suitable valves and controls to serve both ORC cycles. Within the high pressure ORC cycle, VFD pump 220 pressurizes the working fluid to a nominal pressure of 400 psia to cause the working fluid to flow directly through high pressure cycle preheater 212 where it receives heat energy from a portion of the heated jacket water, and then directly to high pressure cycle evaporator 205 where it receives additional heat energy from the exhaust gas flow. The combined heat energy transferred to the working fluid as it passes through these two evaporators causes the working fluid to change state from a heated liquid to a saturated heated vapor. In some embodiments, the heated working fluid may be partially in a liquid state and partially in a vaporized state. The heated and vaporized working fluid is applied to the input of the high pressure cycle expander 224 at an approximate pressure of 390±100 psia and a temperature of 280±25° F. Following expansion, the working fluid flows directly from the expander outlet via 226 at an approximate pressure of 90±30 psia and an approximate temperature of 185±20° F. to a pressurized tank serving as a high pressure cycle separator 227 where any liquid phase portion of the working fluid in equilibrium with the vapor phase portion of the working fluid within the separator may be removed at the bottom. The remaining working fluid in its vapor phase leaves the separator at or near the top and is retained for use in the low pressure ORC cycle, described below, while the liquid working fluid is conveyed directly via 229 to a pressurized tank serving as a low pressure cycle separator 230. In another embodiment, low pressure cycle separator 230 is optional and may be omitted. In such embodiment, low pressure cycle expander outlet 244 may be directly coupled to inlet 231 of condenser subsystem 232 such as the fin fan air cooled condensers available from Guntner U.S. LLC of Schaumburg, Ill., and outlet 229 may be directly coupled via a throttle valve to inlet 231 of condenser subsystem 232.

In some embodiments, condenser subsystem may be a water cooled condenser where cold water input is supplied at inlet 233 and subsequently outlet at 234. In some embodiments, condenser subsystem 232 may be an air-cooled condenser. In some embodiments, condenser subsystem 232 may be utilized to provide heat energy for a desirable secondary purpose, including but not limited to the heating of buildings, domestic or industrial hot water, heating bacterial cultures used for anaerobic digestion of biodegradable waste materials, and the like. In one embodiment, condenser subsystem 232 may be cooled by any suitable alternative means, including but not limited to those utilizing natural environmental resources to dissipate the residual heat energy in the working fluid. The condensed working fluid, now in its liquid state at an approximate temperature of 84° F., is conveyed via outlet 235 directly to working fluid receiver 237 and conveyed via 238 directly to low pressure cycle VFD pump 239. Low pressure cycle VFD pump 239 provides the motive force (nominally 95 psia in this embodiment) necessary to pressurize the low pressure ORC cycle and also provides a portion of the motive force necessary to pressurize the high pressure ORC cycle, the balance of which is provided by high pressure cycle VFD pump 220. In one embodiment, a single VFD pump may provide sufficient motive force for both cycles.

Low pressure cycle VFD pump 239 provides liquid state working fluid via 240 directly to the input of low pressure cycle preheater and evaporator 215, which transfers heat energy from a portion of the jacket water to the working fluid to heat and effect a change of state of the working fluid from liquid to partially or fully vaporized state. The fully or partially vaporized working fluid, at approximate pressure of 90 psia and approximate temperature of 160° F., is then directly conveyed to high pressure cycle separator 227 where it is combined with the partially or fully vaporized working fluid previously expanded in the high pressure cycle expander 224. The partially or fully vaporized working fluid from both sources is applied directly to the inlet 228 of low pressure cycle expander 242 at an approximate pressure of 90±15 psia and approximate temperature of 160°±10° F. Within the expander, the partially or fully vaporized working fluid is expanded, removed at outlet 244 at an approximate pressure of 27 psia and approximate temperature of 113° F., directly conveyed to low pressure cycle separator 230, condenser subsystem 232, and then to VFD pump 239 for repressurization as previously described.

High pressure and low pressure cycle expanders 224 and 242 may be any devices capable of translating a decrease in pressure into mechanical energy, including but not limited to screw-type expanders, other positive displacement machines such as scroll expanders or turbines, and the like. In multi-pressure systems including the 2P ORC system, the expanders may be of similar or different types. In some embodiments, the expanders will be identical machines of the twin screw configuration as taught by Stosic in U.S. Pat. No. 6,296,461. These expanders can be of identical characteristics or may be different.

Such units are available, for example, in the XRV series from Howden Compressors of Glasgow, Scotland. Such expanders utilized in association with the specific temperatures discussed in association with FIG. 204 herein are twin screw expanders and operable with wet (i.e., non-superheated) working fluid from the input through to the output of these expanders. They can thus be operated at much lower temperatures than expanders that require superheated working fluid. They can also be utilized with lower temperature heat sources than those that will superheat typical working fluids such as disclosed herein if the ORC system seeks to utilize up to all of the available heat energy from such a source.

High pressure cycle expander 224 is operatively coupled to electric generator 225, such as the Magnaplus series available from Marathon Electric of Wausau, Wis., so that the mechanical energy produced by expansion of the working fluid may be converted into electric power. Similarly, low pressure cycle expander 242 is operatively coupled to electric generator 243 of similar make and origin. Either or both generators may be coupled to the local power grid for the purpose of delivering electrical energy to the grid.

In some embodiments, either or both of these generators may be used to provide power for local use, particularly when commercial electric power is not available at the location of the prime mover and 2P ORC system. This power may be used for the parasitic loads of the ORC and prime mover, including the numerous pumps and condenser systems often used to support system operation.

The generators may be of the synchronous or asynchronous type, depending upon the particular requirements of the system. In one embodiment, the generators are asynchronous induction machines with their stators operatively coupled to the commercial power grid so that the mechanical energy imparted by the expander to the rotor of the induction machine causes alternating current electric power to be generated and delivered to the commercial power grid.

In one embodiment, the mechanical power from the expander shafts may be coupled to one or more other device or system, including but not limited to the prime mover, a pump, fans, and other power utilizing structure or systems in lieu of being coupled to an electric generator.

From the foregoing, it can be seen that the decrease in pressure of the single working fluid in the 2P ORC system that results from its expansion occurs partially in the high pressure cycle expander 224 and partially in the low pressure cycle expander 242. This distribution and proportion of pressure reduction between the two expanders is one substantial benefit of this invention. As with all physical components, certain operating limitations are imposed on the expanders due to the constraints of fabrication materials, size, and geometry. The prior art does not allow the capture and use of all available heat energy from the prime mover, as is taught in the detailed embodiment described herein, or the heat energy from other prime movers in different applications, for conversion using a single expander and single working fluid or multiple expanders and a shared single working fluid. Attempting to do so would result in the dissipation of wasted heat energy in the ORC system condenser subsystem. By dividing the expansion of highly pressurized working fluid between two expanders, arranged in what can be essentially a series configuration with a precise allocation of the available input heat energy between the two interconnected ORC cycles with a single shared working fluid, better, and in some embodiments the most efficient, operation and output of recovered energy is realized. Additionally, this may also be characterized as an induction configuration with two sources of fully or partially vaporized working fluid supplied to the low pressure cycle expander 242.

Figure 1:
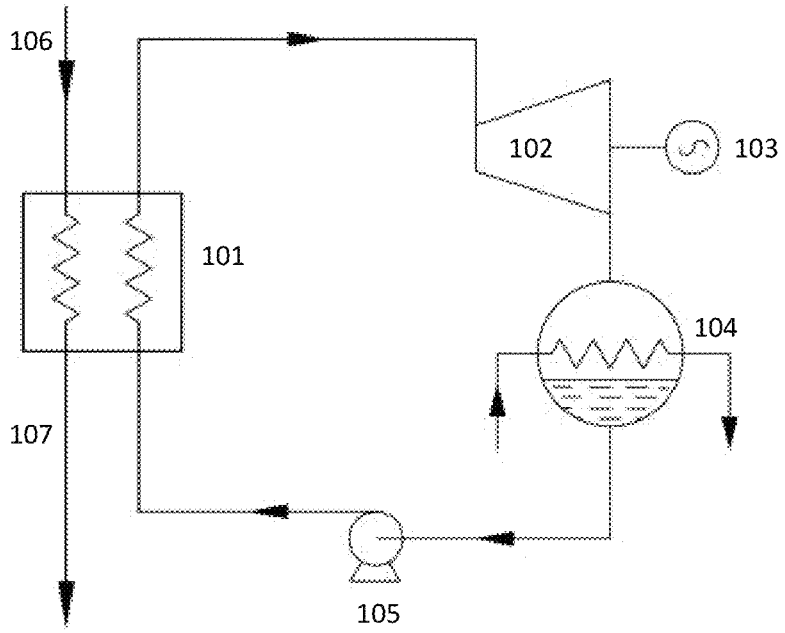
Figure 1 (Prior Art)
FIG. 1 is a block diagram of a prior art ORC system used to convert waste heat energy into electric power.

ORC waste heat recovery systems can be inherently inefficient due to a number of factors. Notably, the physical characteristics of the chosen working fluid can limit the range of temperatures within which the ORC system can effectively convert heat energy via the expansion of pressurized working fluid vapor. Effective heat energy transfer through the heat exchange subsystems, including the thermal oil heat transfer subsystem 203, high pressure cycle evaporator 205, and low pressure cycle preheater and evaporator 215 may each approach 80% only under ideal conditions and may actually yield lower performance than 80%. When cascaded, these sub-unity efficiencies are multiplied and yield an even lower total effective transfer (80% of 80% is 64%). Further, the use of recuperation processes within an ORC system constitute an attempt to recover a portion of excess heat energy that has previously be applied to the system but is not useful for conversion to electrical or mechanical energy and is therefore potentially wasted. As with any thermal process, recuperation is not fully efficient so heat energy is inevitably lost. As a result, in these types of prior art systems much of the available waste heat energy produced by the prime mover is not actually being recovered and transferred to the working fluid. Further, there are significant heat losses within the system due in large measure to the considerable residual heat energy that remains in the post-expansion working fluid and which must be dissipated by the condenser system prior to repressurization by the VFD pump(s). The combined effect of these various losses applied to a prior art ORC system depicted in FIG. 1 that utilize a single twin screw expander, evaporator, and condenser as generally described above along with the same working fluid (R-245fa) can achieve a nominal efficiency of approximately 7% in sustained operation when supplied with the waste heat energy available from a suitable prime mover, such as the Jenbacher J316 in one embodiment taught herein.

Figure 3:
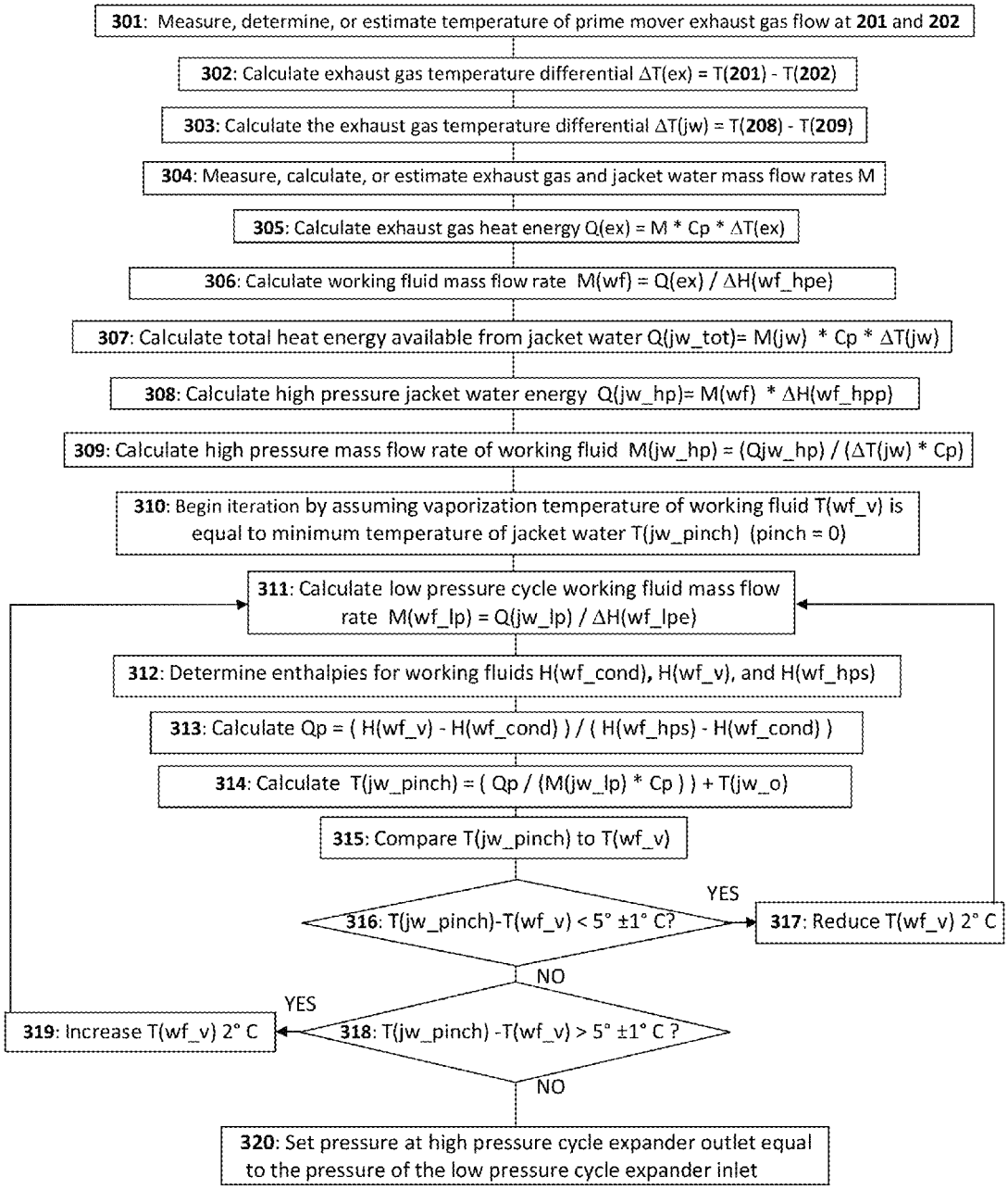
FIG. 3 is a flow chart describing the method in one embodiment of determining the operating parameters for a 2P ORC system.

Embodiments of 2P ORC specified in FIGS. 2-4 and associated text above can improve, and in some embodiments dramatically improve, upon this performance. When supplied with the waste heat energy available from a Jenbacher J316 as the specified prime mover to the particular system identified above, approximately 921 kW of recoverable waste heat energy from exhaust gas above 356° F. and jacket cooling water heat is available for recovery and use by the 2P ORC system. Approximately 458 kW is available from the exhaust gas flow and the remaining 463 kW is present in the jacket water. When all of the available 458 kW of waste heat energy from the exhaust gas flow is provided to the high pressure cycle evaporator 205 via thermal oil heat transfer subsystem 203, 216 kW of available waste heat energy from the jacket cooling water is applied to high pressure cycle preheater 212, and the remaining 247 kW of available waste heat energy from the jacket cooling water is applied low pressure cycle preheater and evaporator 215, the 2P ORC system can produce at least approximately 45 kW of electric power from high pressure cycle generator 225 and another 58 kW of electric power will be produced by low pressure cycle generator 243. The combined 103 kW of electric power generated by the 2P ORC system constitutes an overall conversion efficiency of 11.2% of the waste heat energy of 920 kW available from the prime mover. Accordingly, the 2P ORC system provides an increase of 58% compared to the nominal 7% conversion efficiency of the present art system. This represents a very significant improvement by industry standards.

Additionally, the prior art multiple ORC superheating systems inherently allocate available heat energy in a fashion that cannot be converted and therefore, in some embodiments, is recovered by the recuperation process to salvage some efficiency. Since, however, the superheating/recuperation process itself imposes substantial energy loss to drive the process, the 2P ORC system specified in association with FIGS. 2-4 is substantially more efficient than these types of processes because all or in any event more available heat is allocated to generating power from the specified closed wet working fluid multiple ORC system.

Another significant advantage of the specified 2P ORC system is its ability to fully utilize up to all of the recoverable waste heat energy available in the jacket water of a suitably-matched prime mover. In prior art systems known to the applicants, only a portion of the heat energy in the jacket water can be utilized and the remainder is cooled through the use of conventional radiators that require additional electric power to operate the cooling fans. In the specified embodiment of this specification, however, the 2P ORC system is combined with waste heat generated by, for example, a widely-used prime mover (such as the Jenbacher J316 internal combustion engine) so that up to all of the available heat energy in the jacket water flow may be fed to the 2P ORC system for waste heat energy conversion into electric power. This can obviate the need for a traditional radiator system to support the prime mover that would consume rather than generate electric power. In addition, a substantial portion of the waste heat in the exhaust gas flow can be captured and converted by the specified 2P ORC system and others disclosed herein. Embodiments of these systems also can reduce and, in some embodiments, minimize thermal pollution of the environment.

The distribution of waste heat energy from each source to each of the two ORC cycles in the 2P ORC system is an operating condition that can be calculated and maintained in order to achieve desired, and in some embodiments, optimal performance. The method of determining the distribution of heat energy between the high and low pressure cycles also overcomes the limitations of the prior art which require heat recuperation from the working fluid to minimize losses and therefore constitutes a significant improvement over the prior art. The method may also be utilized to determine and maintain any desired lesser degree of utilization of available waste heat available from the prime mover at the most efficient point of system operation. In addition the following description, the method of determining the 2P ORC system control and set points is provided as a flow chart in FIG. 3.

The first steps in the iterative method of determining the control and set points for 2P ORC system operation require the computation of the available heat energies in the exhaust gas flow and the jacket cooling water (301, 302). For the exhaust gas, the temperature differential T(ex) between the exhaust gas flow T(ex_1) at the input 201 and T(ex_2) at the output 202 to the thermal oil heat transfer subsystem 203 may be measured if such apparatus is available for measurement under operating conditions. If said apparatus is not available, the available heat energy from the exhaust gas flow may be determined from the manufacturer's specification data for the prime mover. If neither is available, the values may be estimated based on best available information, recognizing that errors may be introduced by inaccurate estimations and that further refinement and parameter adjustment will likely be required to compensate for difference between estimated and actual values later realized in practice.

For the jacket water, the same temperature differential between T(jw_1) at the input 208 and T(jw_2) at the output 209 of the jacket water distribution subsystem 210 may be measured, calculated, or estimated using best available resources (303).

The mass flow rates M(ex) of the exhaust gas flow and M(jw) of the jacket water flow of the prime mover may be measured, calculated, or estimated based on best available information (304).

The heat energy Q(ex) contained in the exhaust gas is defined as $$Q(ex) = M(ex)\int_{T(\text{ex_2})}^{T(\text{ex_1})} Cp\,dT$$

where Cp is the specific heat of the exhaust gas mixture, which is generally calculated based on the composition of the exhaust gas and dT is the variable of integration. Assuming that the temperature differential is sufficiently low so that Cp may be considered to be constant at its mean value, Q(ex) may be calculated (305) via $$Q(\text{ex})=M*Cp*\Delta T(\text{ex})$$

where T(ex)=T(ex_1)−T(ex_2). The minimum final temperature of the exhaust gas, T(ex_2), is normally set by the engine manufacturer at some safe level above the acid dew point temperature of the gas depending on the fuel used. As previously described, cooling the exhaust gas below the acid dew point will likely cause damage, including corrosion to the engine exhaust system and waste heat recovery heat exchanger.

The temperature of the heated working fluid may approach that of the waste heat source but never be able to reach it due to the limitations imposed by the Second Law of Thermodynamics and the physical limitations of heat exchangers used to transfer the heat from the source to the working fluid. As a principal consequence, the final temperature of the working fluid being heated can never reach the highest temperature of the source being cooled.

FIG. 4 is a general depiction of the heat energy versus temperature of the source heat and working fluid during a heat transfer process at a pressure similar to that which may occur in the low pressure ORC cycle. The data depicted in this figure is illustrative of the performance of some embodiments but is not meant to be an accurate numerical representation of any particular embodiment. However, the properties of the example working fluid closely resemble those of R-245fa Genetron refrigerant which exhibits a saturation temperature of 70° C. at a nominal pressure of 90 psia as may exist at inlet 228 to low pressure cycle expander 242. Line segment 401 represents the source heat and segment 402 represents the working fluid. Point 404 depicts the state of the jacket water at inlet 214 and point 403 represents the state of the jacket water at outlet 217 of low pressure cycle preheater and evaporator 215. In this example, the jacket water experiences a decrease in temperature of approximately 35° C. (from 100° C. to 65° C.). In a similar manner, point 405 represents the state of the working fluid at inlet 240 and point 406 represents the state of the working fluid at outlet 241 of low pressure cycle preheater and evaporator 215. Along this path, it can be seen that the temperature of the working fluid increases from 30° C. to 70° C., which in this example is the temperature at which the working fluid begins to vaporize at the liquid saturation temperature. Although the temperature does not increase beyond this vaporization temperature in this example, the heat energy content of the working fluid continues to increase as it receives additional heat energy from the jacket water and the working fluid is increasingly vaporized.

During this heat transfer process, the paths representing the working fluid heating and jacket water cooling processes do not intersect, lest there be no additional heat transfer between the source and working fluid, in accordance with the Second Law of Thermodynamics. That is, the temperature of the working fluid can never equal that of the waste heat energy input and will always be lower by a certain amount. The temperature at the closest distance between these two paths, point 407, is normally referred to as the "pinch point". It is the minimum temperature difference between the source and working fluid at any point in the heat exchanger. In the design of ORC power plant evaporators, condensers, heat exchangers, and the like, the pinch point is used to determine the pressure, temperature and mass flow of the working fluid leaving the heat exchanger.

In some embodiments, the pinch may be selected to be as low as 3° C. and as high as 10° C. However, the pinch is usually selected by ORC design engineers to be approximately 5° to 10° C. depending on the absolute temperature of the source. The pinch value depicted in the example of FIG. 4 is approximately 5° C. Selection of a larger pinch value reduces system efficiency while selection of a pinch value that is too small increases surface requirements of the heat exchanger and corresponding cost. Since the temperature of the waste heat energy flow decreases as it passes through the evaporator, in the preferred embodiment the working fluid output is in closest contact with the waste heat energy input and the working fluid input in closest contact with the waste heat energy output (counterflow).

In one embodiment, the heat contained in the prime mover's exhaust gas is applied to high pressure cycle heat exchanger 205 either directly or via thermal oil heat transfer subsystem 203, and the design conditions of the high pressure ORC cycle are generally set by the temperature and pressure specifications and limitations of the expander. Those limits are imposed by the heat exchanger's pinch point. In particular, the temperature and pressure of the working fluid heated by the exhaust gas flow may not exceed the rated values for the expander's inlet.

Having determined the heat energy of the exhaust gas and assuming that all of this heat is transferred to the working fluid, the mass flow rate of the working fluid M(wf) may be computed (306) via $$M(\mathrm{wf})=Q(\mathrm{ex})/\Delta H(\mathrm{wf_hpe})$$

where H(wf_hpe) represents the difference in the enthalpy, or total energy, of the working fluid between the high pressure cycle evaporator 205 outlet 223 and inlet 222 which corresponds to a temperature approximately 5° C. below the maximum temperature of the low temperature source. In other words, the working fluid mass flow rate can be determined by the amount of exhaust heat used and by the minimum and maximum enthalpy of the working fluid heated either directly or indirectly (via thermal oil loop) by the exhaust gas.

The total heat energy available from all jacket cooling water is typically provided by the engine manufacturer and also may be calculated (307) via $$Q(\mathrm{jw_tot})=M(\mathrm{jw})*Cp*\Delta T(\mathrm{jw})$$

where T(jw) represents the difference in the temperature of the jacket cooling water between the inlet 208 and the outlet 209 of the jacket water distribution subsystem 210.

As previously described, waste heat energy from the jacket cooling water may be provided to the high pressure ORC cycle via the high pressure cycle preheater 212 that receives a portion of the jacket cooling water from jacket water distribution subsystem 210, depending on the maximum temperature of the jacket water. The amount of jacket water heat energy required for the high pressure cycle may be calculated (308) via $$Q(\mathrm{jw_hp})=M(\mathrm{wf})*\Delta H(\mathrm{wf_hpp})$$

where H(wf_hpp) represents the difference in the enthalpy of the working fluid between the outlet 222 and the inlet 221 to high pressure cycle preheater 212.

The quantity of jacket water provided to the high pressure cycle by jacket water distribution subsystem 210 and control subsystem 219 is determined by the temperature difference of the jacket water circuit as specified by the manufacturer of the prime mover. That mass flow rate may be calculated at the outlet 222 of high pressure cycle preheater 212 (309):

$$M(\mathrm{jw_hp})=(Q(\mathrm{jw_hp})/\Delta T(\mathrm{jw})*Cp)$$

VFD pump 220 controls the pressure at the input to high pressure cycle expander 224, and via control subsystem 219, the mass flow rate of the working fluid in the high pressure cycle is set to achieve the desired temperature and pressure at the inlet of high pressure cycle expander 224.

The total waste heat energy contained in the jacket water available for the low pressure cycle is the difference between the total jacket water heat available and that already applied to the high pressure cycle preheater 212 as calculated above:

$$Q(\text{jw_lp})=Q(\text{jw_tot})-Q(\text{jw_hp})$$

The temperature and pressure at low pressure cycle expander inlet 228 for optimal system performance may now be determined iteratively via the following method:

1) Assume that the temperature of the vaporized working fluid T(wf_v) is equal to the minimum temperature of the jacket water T(jw_pinch) in the low pressure cycle. This is equivalent to setting the initial value of the pinch in the cycle to zero (310).
2) Calculate the mass flow rate of the working fluid in the low pressure cycle (311) via $$M(\text{wf_lp})=Q(\text{jw_lp})/\Delta H(\text{wf_lpe})$$

where H(wf_lpe) represents the difference in enthalpy of the working fluid leaving the low pressure cycle preheater and evaporator 215 at 241 (where its enthalpy is maximum) and at the entry to the low pressure cycle preheater and evaporator 215 at 240.

3) Using the working fluid property tables, determine the enthalpies (312): a) H(wf_cond) of the working fluid in the low pressure cycle at the outlet 235 of condenser subsystem 232, b) H(wf_v) at the point of initial vaporization (saturated liquid), and c) H(wf_hps) at high pressure cycle separator 227 inlet flow 241.
4) Calculate heat addition at the pinch point Qp (313):

$$Qp=[(H(\text{wf_v})-H(\text{wf_cond}))/(H(\text{wf_hps})-H(\text{wf_cond}))]*Q(\text{jw_lp})$$

5) Because $$Qp=M(\text{jw_lp})*Cp*(T(\text{jw_pinch})-T(\text{jw_o}))$$

we may calculate (314)

$$T(\text{jw_pinch})=(Qp/(M(\text{jw_lp})*Cp))+T(\text{jw_o})$$

where T(jw_pinch) is the temperature of the jacket water at the pinch point and T(jw_o) is the temperature of the jacket water at the outlet 217 of low pressure cycle preheater and evaporator 215.

6) Compare (315) T(jw_pinch) to T(wf_v). If the difference is less than 5° C. (316) (the desired pinch value), reduce T(wf_v) by 2° C. (317) and repeat the iteration. If the difference between T(jw_pinch) and T(wf_v) is greater than 5° C. (318), increase T(wf_v) by 2° C. (319) and reiterate.
7) Continue the iteration until the pinch (T(jw_pinch)−T(wf_v)) is 5° C. plus or minus 1° C.

Finally, once the parameters of the low pressure cycle have been determined in this manner, the pressure at the high pressure cycle expander outlet 226 may be set to the pressure of the low pressure cycle expander inlet 228 (320). In one embodiment, one or more control valves or other means of controlling the pressure may be incorporated in the system.

Figure 5A:
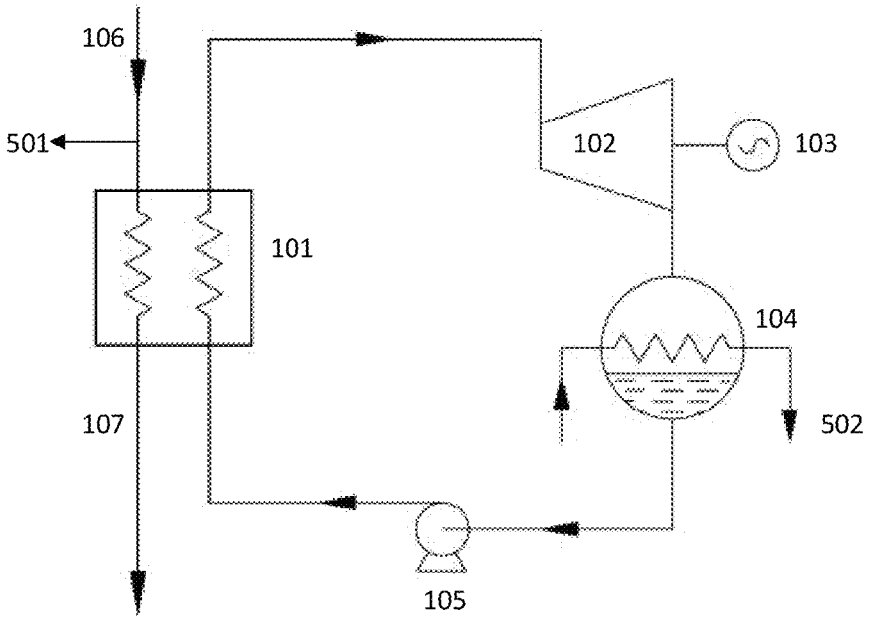
Figure 5A (Prior Art)
FIG. 5A is a block diagram of a prior art ORC system used to convert waste heat energy into electric power including heat extraction ports that can be used to provide heat for other applications.
Figure 5B:
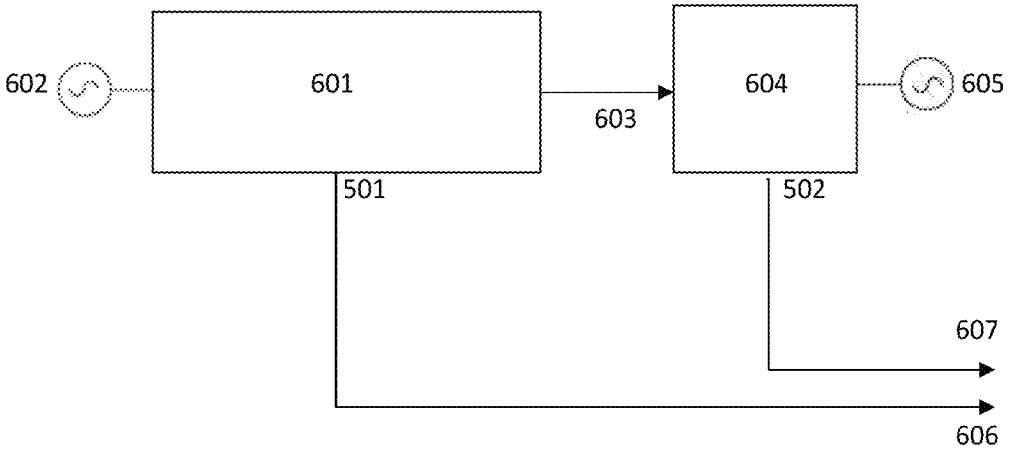
Figure 5B (Prior Art)
FIG. 5B is a block diagram of the energy flow in a prior art system including a prime mover, an ORC system used to convert waste heat energy into electric power, and heat extraction ports for other non-system applications.

With respect to the depiction of heated extraction ports in the prior art systems depicted in FIGS. 5 and 6, the same possibilities exist for MP ORC systems. The condenser subsystem 232 may be replaced, in whole or in part, by an alternate subsystem that utilizes the residual heat energy present in the post-expansion working fluid for any other useful purpose.

In addition to the use of jacket water distribution subsystem 210 disclosed in detail above, other distribution systems and apparatus may be used to portion, distribute, and communicate heat energy from one or more sources other than jacket cooling water to more than one heat exchanger in a myriad of other applications. In embodiments where heat energy may be communicated via a recirculating liquid medium such as water, oil, an organic compound, or an inorganic compound, a distribution system highly similar to that of the jacket water distribution subsystem 210 with both an inlet 208 and an outlet 209 operative to provide closed-loop circulation. In other embodiments where there is no requirement for or advantage in recirculating a heat transfer media, including but not limited to heat transfer from exhaust gasses, heat transfer media may be expelled from the outlet of said distribution system once the available heat energy has been extracted.

Embodiments that consume up to all of the available heat energy from jacket water of internal combustion engines provide a number of concurrent advantages and solve several problems at once. Heat must be extracted from the recirculating jacket water and dissipated to maintain engine operation within the manufacturer's specified range. This is typically accomplished in the known art via the use of one or more conventional radiators, often cooled via forced air flow provided by the consumption of additional energy in the form of electricity to drive large fans, rotational energy generated by the engine via fuel consumption, or the like. The recovery of rotational power via expansion of a working fluid heated by said jacket water performs the identical function as does a conventional radiator but also generates mechanical or electrical power rather than consuming power as does a conventional radiator.

A similar situation exists in the use of turbochargers, particularly those associated with large industrial engines. In a turbocharged engine, the intake airflow is intentionally increased over that provided to a normally-aspirated engine via the use of compression means, often comprising one or more turbines, to increase the density of the charge air supplied to the engine for combustion. The increased density of the charge air, and particularly the presence of additional oxygen necessary for fuel combustion, enables a turbocharged engine to deliver greater output power than a comparable engine with a normally-aspirated combustion system.

However, the compression of charge air in a turbocharger dramatically increases its temperature, which in turn creates other problems. The density of a gas is inversely proportional to its temperature, and at least a portion of the increased density provided by the compression of turbocharging is offset by the reduction in density due to increased temperature. Further, increasing the temperature of the intake airflow also increases the combustion temperature within the engine as well as the temperature of the resulting exhaust gas. Finally, increased temperatures within engine combustion chambers generally results in the production of increased levels of undesired exhaust gas products, including mono-nitrogen oxides such as nitric oxide and nitrogen dioxide generally referred to as $NO_x$.

For the purposes of this disclosure, the term "charge air" is intended to refer to any stream of compressed air at an elevated temperature, thereby encompassing comparable systems, techniques, and processes also associated with heated streams of compressed air or gasses including but not limited to "scavenge air", "intercooling", and the like.

Industrial turbocharging applications that require significant power generate significant quantities of heat at temperatures well-suited for recovery of mechanical or electrical power. For example, a single internal combustion engine such as the K80MC-S9 dual fuel 2-stroke engine manufactured and sold by MAN Diesel & Turbo SE generates in excess of 40 MW of output power, and in doing so requires potential charge air cooling at a rate on the order of 17 MW, depending in part on the temperature of the ambient intake air. What is needed is a solution that consumes heat from the compressed charge air stream, thereby reducing its temperature to avoid the adverse consequences identified above. Applicant's system of input heat distribution discussed previously with respect to heated jacket water distribution provides a novel solution to this problem while providing the advantages of mechanical and electrical power described elsewhere herein.

The disclosure that follows draws heavily upon the basic principles of mechanical and electrical power recovery from heat source(s) disclosed above in great detail. While the differences between the previously-presented embodiments and those disclosed below will be identified to the greatest extent possible, common elements of said embodiments will be presumed to be understood from the entire scope of this specification. All material presented elsewhere herein is intended to apply to the following embodiments as well unless specifically disclaimed as not being pertinent to any particular embodiment.

Whenever discussed with respect to the following embodiments, the interchangeable terms "working fluid" and "ORC working fluid" are intended to apply to any medium suitable for use in an ORC system for heating and expansion to generate mechanical or electrical power via an expander of any known configuration, including but not limited to a twin screw expander capable of operating with a partially-vaporized "wet" working fluid. In some embodiments, said working fluid is an organic refrigerant disclosed in detail elsewhere herein. Additionally, the term "heat transfer medium" refers to any medium suitable for use in transferring heat energy from a source to a destination, particularly via the use of one or more heat exchanger(s). Any gas, liquid, or combination thereof suitable for this purpose is envisioned by the scope of this disclosure, including but not limited to air, other gasses, water, oil, organic compounds, inorganic compounds, other liquids, or any combination of one or more of the foregoing. Whenever any heat transfer medium is referred to as "heated transfer medium" or simply a "heated medium", it is intended to denote that said medium has previously received heat energy from a source in its capacity as an agent for the transfer of heat energy from a source to a destination, usually between the source of heat such as a heat stream or between a first heat exchanger serving as a source of heat energy and either a second heat exchanger or a condenser serving as the destination of said heat energy. When a "separate heat transfer medium" is disclosed, it should be appreciated that this refers only to the fact that the flow of said separate medium is not commingled with the flow of any other heat transfer medium. Separate heat transfer media may be of identical or different composition independent from that of any other heat transfer media without limitation, and the only connotation that should be drawn from a disclosure of "separate" medium is that said medium is a quantity distinct from any other medium.

Figure 6A:
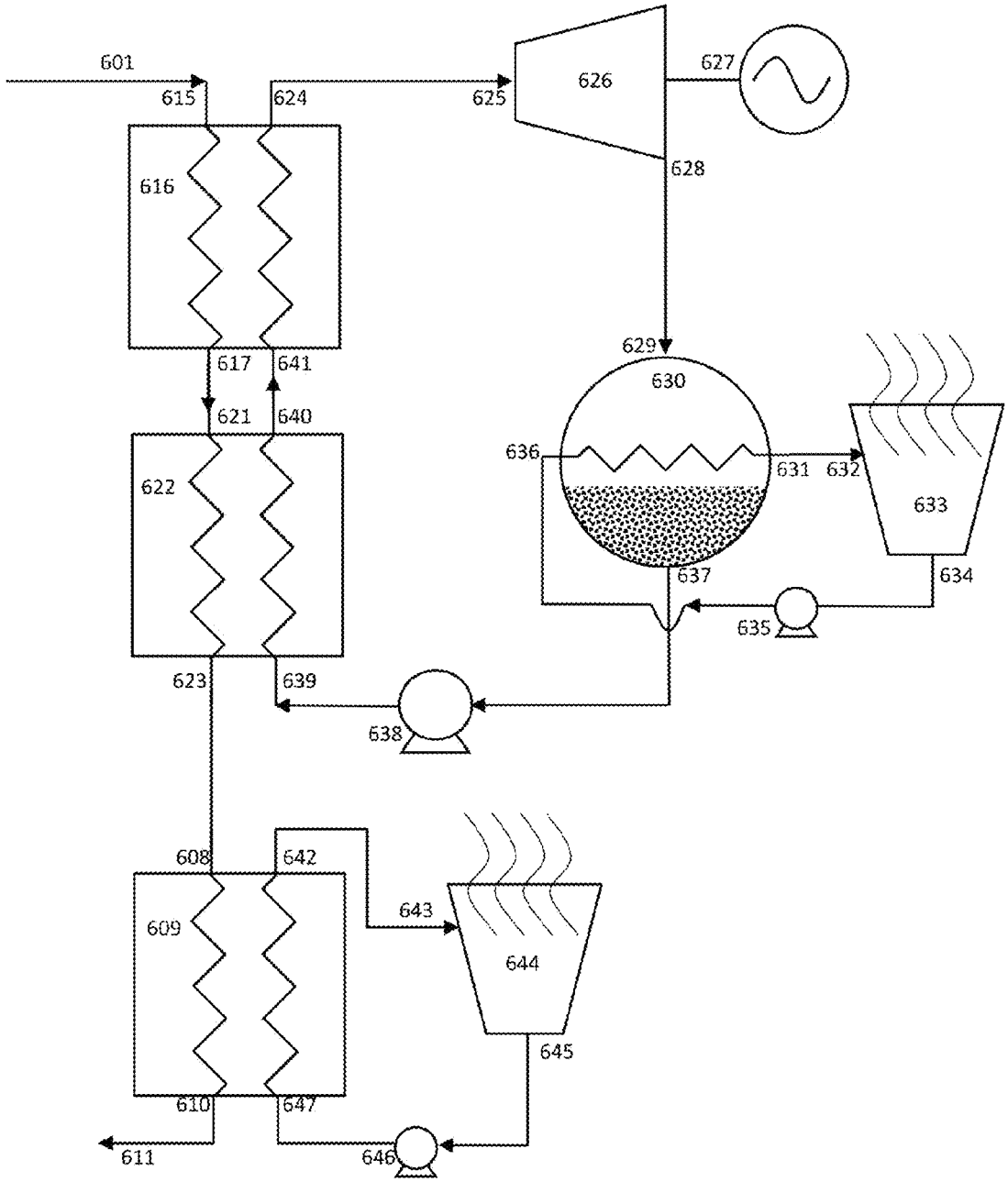
FIG. 6A is a block diagram of one embodiment of the invention depicting the flow of a charge air heat stream apportioned via passage through multiple heat exchangers.

With reference to FIG. 6A, an input heat stream 601 is applied to heat source input 615 of heat exchanger 616. In general, heat stream 601 may comprise a flow of any medium or combination of media suitable for use in transferring heat energy to the working fluid in the organic Rankine cycle (ORC) system comprising heat exchangers 616 and 622, expander 626, condenser 630 and associated components including but not limited to radiator 633 and pump 635, and ORC system pump 638. In one embodiment, heat stream 601 comprises a flow of compressed charge air communicated from a turbocharger or any similar source of compressed air. In other embodiments, heat stream 601 may comprise a flow of any other pressurized or unpressurized gas or any liquid medium of sufficient temperature and mass flow rate so as to increase the enthalpy of the working fluid to at least a semi-vaporized state suitable for expansion in expander 626. For the purpose of describing the basic operation of the embodiment depicted in FIG. 6A, the heat stream will be presumed to be a flow of compressed charge air of elevated temperature and density produced by and communicated from a turbocharger for use in an internal combustion engine. As such, the temperature of heat stream 601 is at its greatest temperature at heat exchanger input 616.

As the heated media of heat stream 601 passes through heat exchanger 616, a first portion of heat energy is transferred from said heat stream to the working fluid flowing through said heat exchanger in the opposite (counterflowing) direction, ensuring that the highest temperature media in the heat stream is proximate to the working fluid at the working fluid output 624 of heat exchanger 616. Said heated working fluid is communicated to working fluid inlet 625 of expander 626 where it is expanded, thereby generating rotational mechanical energy communicated in this embodiment to electric generator 627. Expanded working fluid exits expander 626 at outlet 628 and is communicated to condenser 630 at condenser inlet 629. Condenser 630, radiator 633, and pump 635 comprise a condensing and cooling system for the expanded working fluid wherein the working fluid is cooled to a sufficiently liquid state to permit repressurization by ORC system pump 638. In some embodiments, the condensing and cooling system may comprise a working fluid collector or other reservoir for condensed working fluid. In other embodiments, said condensing and cooling system does not required a working fluid collector or other reservoir. In one embodiment, the condensing and cooling system may comprise one or more forced air radiators, one or more liquid cooled radiators, or any other apparatus known in the art wherein residual heat may be extracted from expanded working fluid. FIG. 6 depicts a circulating system whereby a separate heat transfer medium in heat receiving communication with the expanded working fluid is circulated under pressure from pump 635 through a heat transfer medium input 636, heat transfer medium output 631, radiator 633 input 632, and radiator output 634. The individual elements shown in FIG. 6A are not limiting on the scope of this disclosure, as any known heat exchanger apparatus known in the art or later developed is envisioned for the purpose at hand. Cooled working fluid exits the condensing and cooling system at outlet 637 and is communicated to ORC system pump 638 for repressurization.

Cooled and pressurized working fluid is communicated first to heat exchanger 622, functioning as a preheater, and then to heat exchanger 616. Heat stream 601, after having flowed through heat exchanger 616 via heat source input 615 and heat source output 617, is now communicated to heat exchanger 622 at heat source input 621. As a first portion of the heat energy present at heat source input 615 of heat exchanger 616 has already been transferred to the working fluid therein, the temperature of the working fluid in heat exchanger 622 is lower than that of the working fluid in heat exchanger 616. However, a second portion of heat energy is communicated to the counterflowing working fluid entering heat exchanger 622 at working fluid input 639 and exiting at working fluid output 640, thereby increasing the temperature of said working fluid which is then communicated to heat exchanger 616 via working fluid input 641.

After having passed through heat exchangers 616 and 622, heat stream 601 is next communicated from heat source output 623 of heat exchanger 622 to a supplemental condensing and cooling system comprising heat exchanger 609, radiator 644, pump 646, and a separate heat transfer medium circulating therein under pressure supplied by pump 646. The partially-depleted pressurized heat stream 601 enters heat exchanger 609 at heat source input 608 and exits at output 610, whereupon it is communicated to the engine air inlet 611 for injection into the combustion chambers. During its passage through heat exchanger 609, a third portion of heat energy is transferred from heat stream 601 to the separate heat transfer medium which is subsequently cooled via radiator 644, which may also be any apparatus known in the art or later developed for the purpose at hand.

During its passage through heat exchangers 616, 622, and 609, three portions of heat energy have been extracted from heat stream 601, thereby reducing its temperature. The heat energy transferred to the ORC working fluid via heat exchangers 616 and 622 have been utilized to heat said working fluid for expansion in expander 626 and generation of mechanical and electrical power. However, in some embodiments, the temperature of heat stream 601 exiting heat exchanger 622 at output 623 is not yet optimally conditioned for application to the engine and further heat must be removed; this function is provided by the supplemental condensing and cooling system comprising heat exchanger 609. In view of limitations on the temperature and mass flow rate necessary for applications involving ORC systems, and the occasional need to remove the ORC system from operation for maintenance, the supplemental condensing and cooling system is configured to remove any and all remaining excess heat energy from heat stream 601 so as to present the compressed charge air to the engine air inlet 611 at the desired temperature.

Figure 6B:
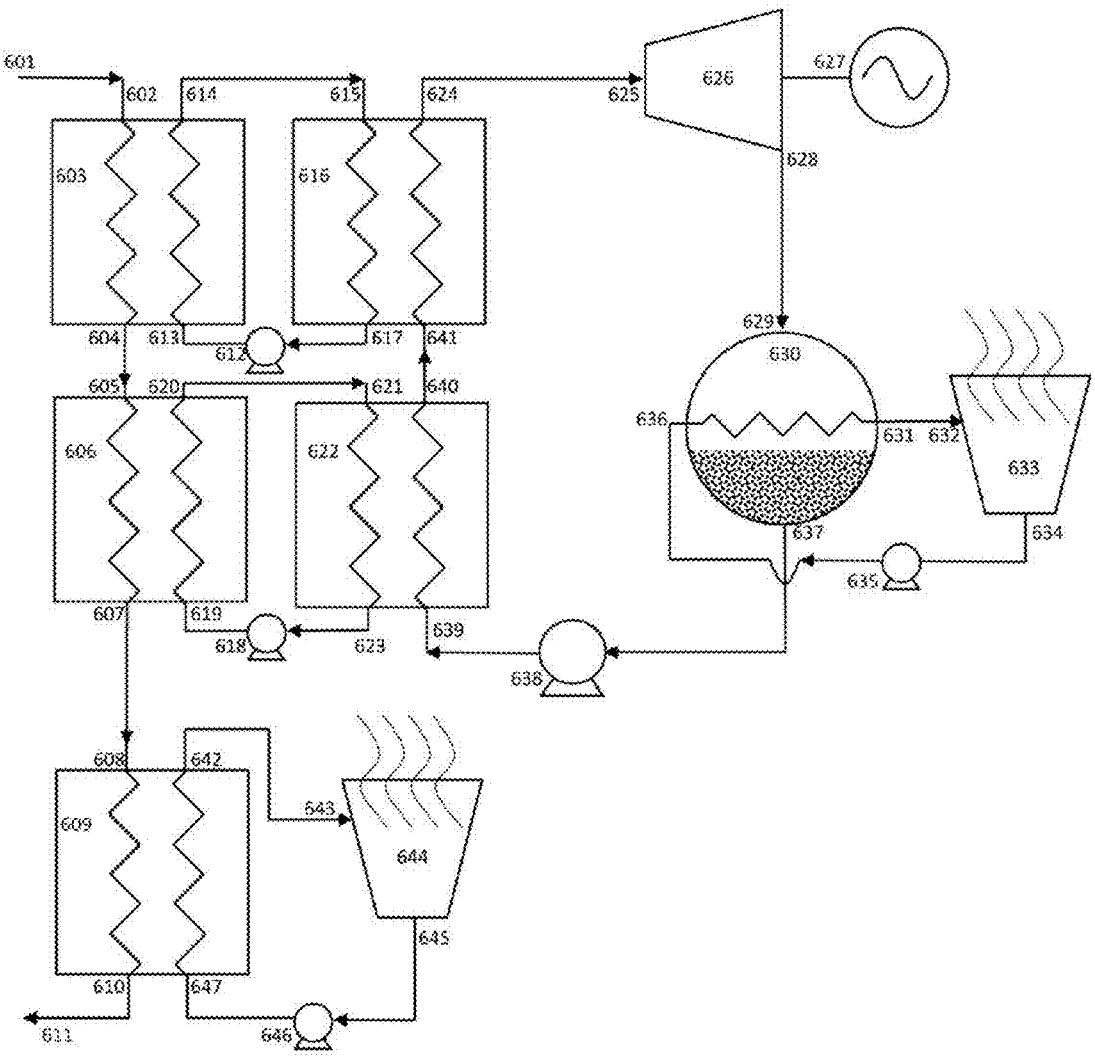
FIG. 6B is a block diagram of one embodiment of the invention depicting the flow of a charge air heat stream apportioned via passage through multiple intermediate heat exchangers in heat transfer communication with ORC heat exchangers.

With reference now to FIG. 6B, a system further comprising intermediate heat exchangers 603 and 606 is depicted. In this embodiment, heat stream 601 passes through each of said intermediate heat exchangers in sequence and communicates each of the first and second portions of heat energy from said heat stream to a heat transfer medium flowing therein. The heat transfer medium of each intermediate heat exchanger is in further heat transfer communication with each of the heat exchangers depicted in the previously-described embodiment. For example, a first portion of heat energy is extracted from heat stream 601 via passage through intermediate heat exchanger 603 during its passage from heat source input 602 to heat source output 604, and said first portion of heat energy is communicated to the separate heat transfer medium circulating between media input 613, media output 614, heat source input 615 of heat exchanger 616, and heat source output 617 of heat exchanger 616 under pressure from pump 612. Subsequently, a portion of the heat energy present in the heat transfer media received at input 615 of heat exchanger 616 is communicated to the ORC working fluid as previously described before exiting at output 617 for continuous recirculation.

In an identical manner, the second portion of heat energy is extracted from heat stream 601 during passage between heat source input 605 and heat source output 607 of heat exchanger 606, whereupon said second portion of heat energy is communicated to the heat transfer medium circulating between media input 619, media output 620, heat source input 621 of heat exchanger 622, and heat source output 623 of heat exchanger 622 under pressure from pump 618. Subsequently, heat energy present in the heat transfer media received at input 621 of heat exchanger 622 is communicated to the ORC working fluid as previously described before exiting at output 623 for continuous recirculation.

The use of intermediate heat exchangers generally introduces a certain additional amount of heat loss between each stage since any transfer of heat energy is subject to some degree of unintentional dissipation. However. In some embodiments, it may be impractical or unfeasible to locate the ORC system sufficiently proximate to the flow of compressed charge air to achieve direct heat transfer communication as depicted in FIG. 6A. For example, the necessity for long working fluid conduits between the ORC and the charge air stream may require an excessive quantity of working fluid that would be problematic for various reasons. In such cases, the ability to communicate said separate heat transfer media, including but not limited to a liquid such as an oil or other inexpensive and stable fluid with appropriate physical and thermal characteristics, from an intermediate heat exchanger to each of the ORC heat exchangers may be advantageous. Additionally, the reduced size and configurability of said intermediate heat exchangers may be preferred in some physical installations due to constraints on available space, safety concerns, and the like.

Figure 7A:
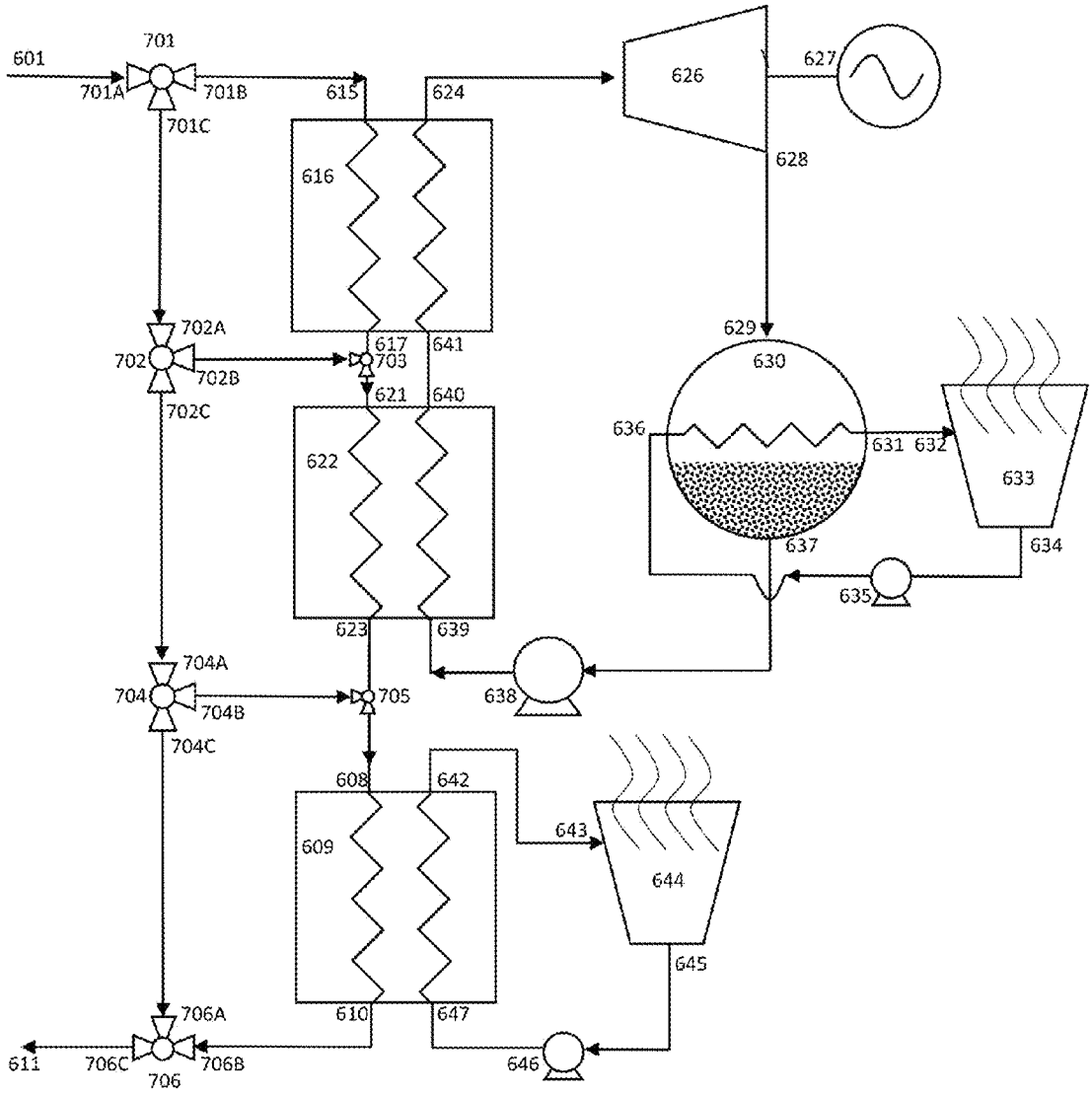
FIG. 7A is a block diagram of the embodiment of the invention depicted in FIG. 6A further comprising multiple flow control valves to permit controlled apportionment and distribution of the heat energy from the flow of a charge air heat stream.

The embodiments of FIGS. 6A and 6B comprise a direct and sequential flow of heat stream 601 through more than one heat exchangers. While this provides apportionment of the heat energy into at least three portions, the previous embodiment does not permit the distribution of heat energy from said heat stream to each of the heat exchangers in a precise proportion as may be desired. With reference to FIG. 7A, an embodiment is depicted further comprising a series of valves added to the embodiment of FIG. 6A. Specifically, heat stream 601 may be apportioned by valve 701 to direct a first applied portion of said heat stream received at valve input 701A to the heat source input 615 of heat exchanger 616 via valve output 701B and to direct the first remaining portion of said heat stream to subsequent heat exchangers via valve output 701C.

Subsequently, said first remaining portion of heat stream 601 received at input 702A of valve 702 may be further divided into a second applied portion directed to valve output 702B for injection into heat source input 621 of heat exchanger 622 via valve 703, where it is combined with the flow between heat source output 617 of heat exchanger 616 and heat source input 621 of heat exchanger 622, with a second remaining portion of heat stream 601 provided by valve output 702C for use by subsequent heat exchangers.

Next, the second remaining portion of heat stream 601 received at input 704A of valve 704 may be further divided into a third applied portion directed to valve output 704B for injection into heat source input 608 of heat exchanger 609 via valve 705, where it is combined with the flow between heat source output 623 of heat exchanger 622 and heat source input 608 of heat exchanger 609, and a third remaining portion provided by valve output 704C for subsequent communication.

Finally, valve 706 receives and combines said third remaining portion of heat stream 601 at valve input 706A with the flow received from heat source output 610 of heat exchanger 609 via valve input 706B and provides said combined flow at valve output 706C for communication to engine air inlet 611.

This configuration provides the ability to direct a precise portion of the heat energy present in heat stream 601 to each of the several heat source inputs in the system (615, 621, and 608). In this manner, each of the ORC heat exchangers may be configured to operate with the desired quantity of heat energy. Depending on the specific characteristics of the charge air heat stream 601, which may vary according to ambient temperature, engine operating characteristics, and the like, full control and optimization of the ORC system may be successfully maintained. As described above and depicted in the drawings, heat exchanger 609 provides only supplemental cooling and operates independently of the ORC system. Any excess heat energy present in the charge air heat stream 601 not beneficially utilized by either ORC heat exchanger (616 or 622) may be safely provided to the supplemental condensing and cooling system comprising heat exchanger 609, where it may be independently consumed without adverse effect on ORC operation.

Figure 7B:
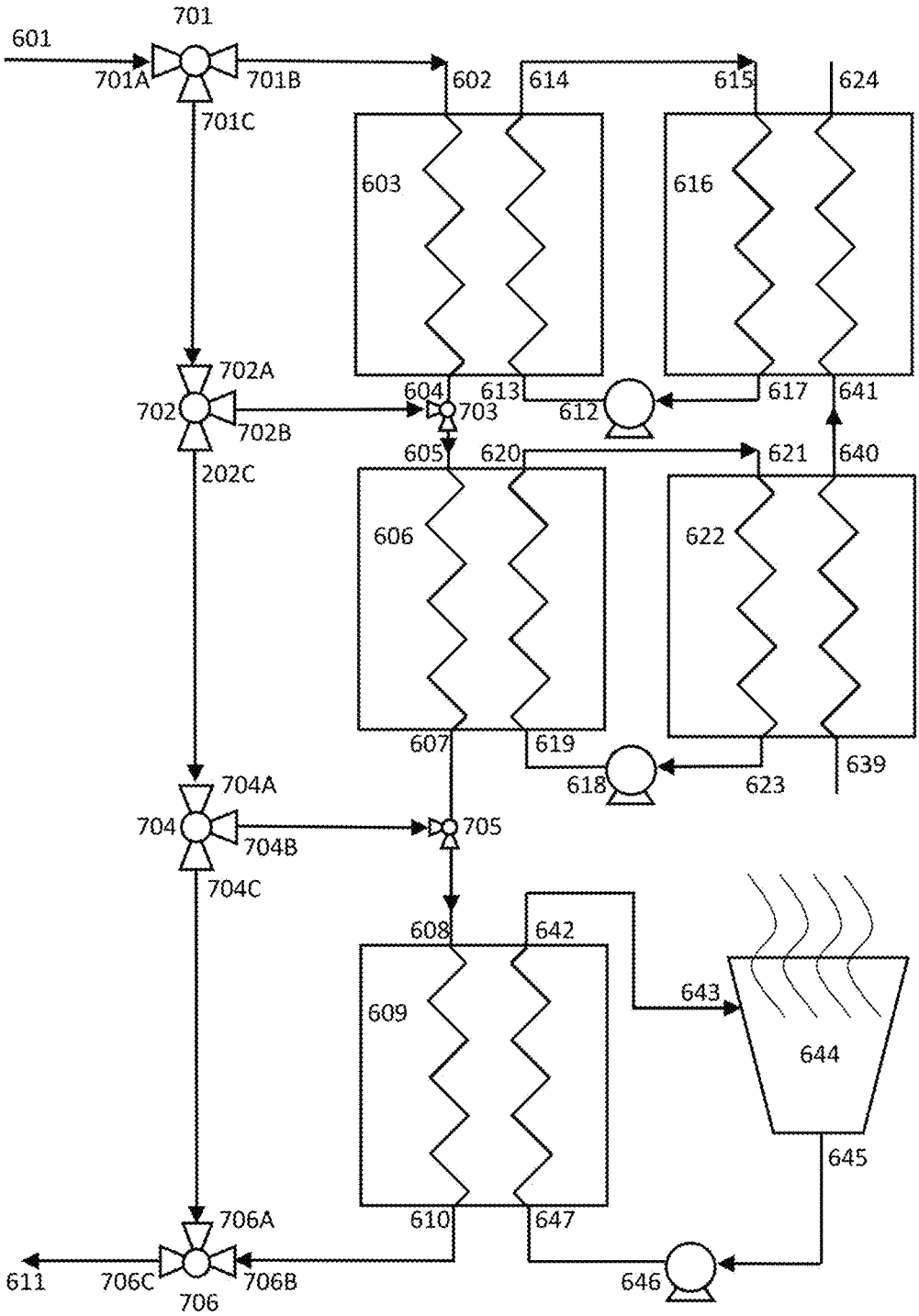
FIG. 7B is a block diagram of the embodiment of the invention depicted in FIG. 6B further comprising multiple flow control valves to permit controlled apportionment and distribution of the heat energy from the flow of a charge air heat stream.

FIG. 7B depicts the embodiment of FIG. 6B further comprising the same valves disposed at equivalent positions with respect to intermediate heat exchangers 603 and 606. The same degree of flexibility and control is provided, as each of the intermediate heat exchangers is in exclusive heat transfer communication with their respective ORC heat exchanger counterparts (603 with 616, and 606 with 622). This embodiment combines the advantages of the embodiments of FIGS. 6B and 7A, namely the ability to precisely control the distribution of heat energy from the charge air heat stream 601 via a series of flow control valves while simultaneously offering the option of using intermediate heat exchanges for the reasons given above.

Figure 8A:
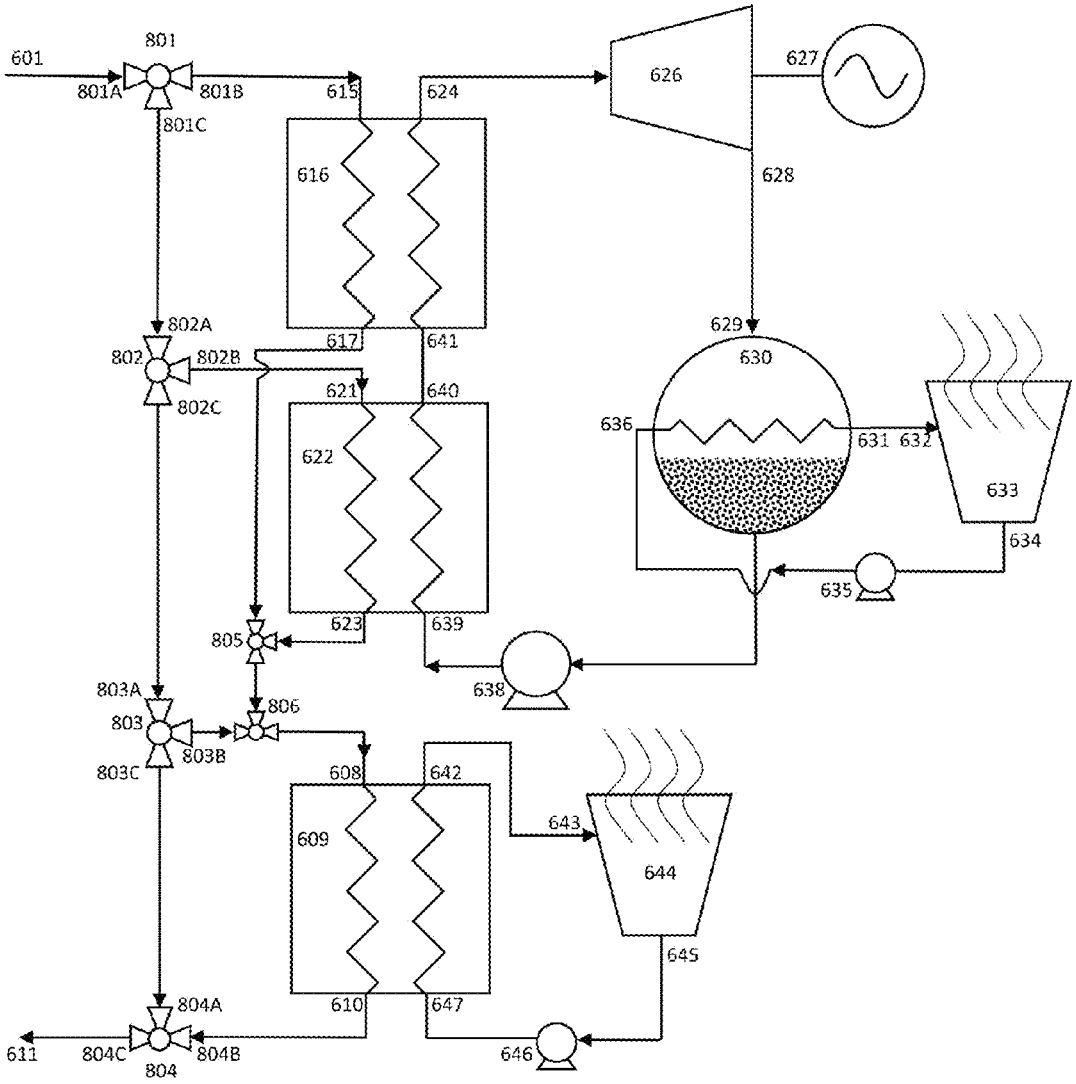
FIG. 8A is a block diagram of the embodiment of the invention depicted in FIG. 7A further comprising an alternate flow control valve scheme to permit controlled apportionment and distribution of the heat energy from the flow of a charge air heat stream.

While the embodiments of FIGS. 7A and 7B permit injection of precise portions of heat stream 601 at each of the various component inputs, they require that portions of the heat stream injected at upstream inputs also flow downstream through all subsequent components. In some instances, this scheme may not permit precise determination of the actual system temperatures. In FIG. 8A, an embodiment comprising an alternate configuration of valves is depicted wherein the heat source outputs of the ORC heat exchangers are isolated from the heat source inputs of the following heat exchangers. Specifically, valve 801 provides a first applied portion of the heat stream 601 received at valve input 801A to heat source input 615 of heat exchanger 616 via valve output 801B and a first remaining portion of said heat stream to valve output 801C. Similarly, valve 802 provides a second applied portion of the heat stream 601 received at valve input 802A to heat source input 621 of heat exchanger 622 via valve output 802B and a second remaining portion of said heat stream to valve output 802C.

In both cases, heat source inputs 615 and 621 receive their respective portions of the charge air heat stream 601 directly from the valves in communication with the source of said heat stream. As such, the temperature of the portions of the heat stream provided to inputs 615 and 621 will be at essentially identical temperatures. In the previously-described embodiment of FIGS. 7A and 7B, the temperature of the heat stream at heat source input 621 was determined by the temperature of the second portion of heat stream 601 injected at valve 703, the temperature of the partially heat-depleted first portion of the heat stream previously provided to heat source input 615 and output at heat source output 604, and the relative mass flow rates of each of those two portions as they were combined at valve 703. Unlike those previously-described embodiments, heat source output 617 of heat exchanger 616 is not communicatively coupled to heat source input 621 of heat exchanger 622 in the embodiment of FIG. 8A. Instead, heat source output 617 is communicatively coupled to valve 805, where the output flow is combined with the output flow from heat source output 623 of heat exchanger 622. The combined flow from outputs 617 and 623 are then communicated via valve 806, which is also in flow receiving communication with valve 803 to receive the second remaining portion of heat flow 601, and provide the combined flow to the supplemental condensing and cooling system via heat source input 608 of heat exchanger 609 as previously described. The configuration of this embodiment is particularly advantageous when the heat stream portions applied to each of the heat exchangers require the highest possible temperatures.

Figure 8B:
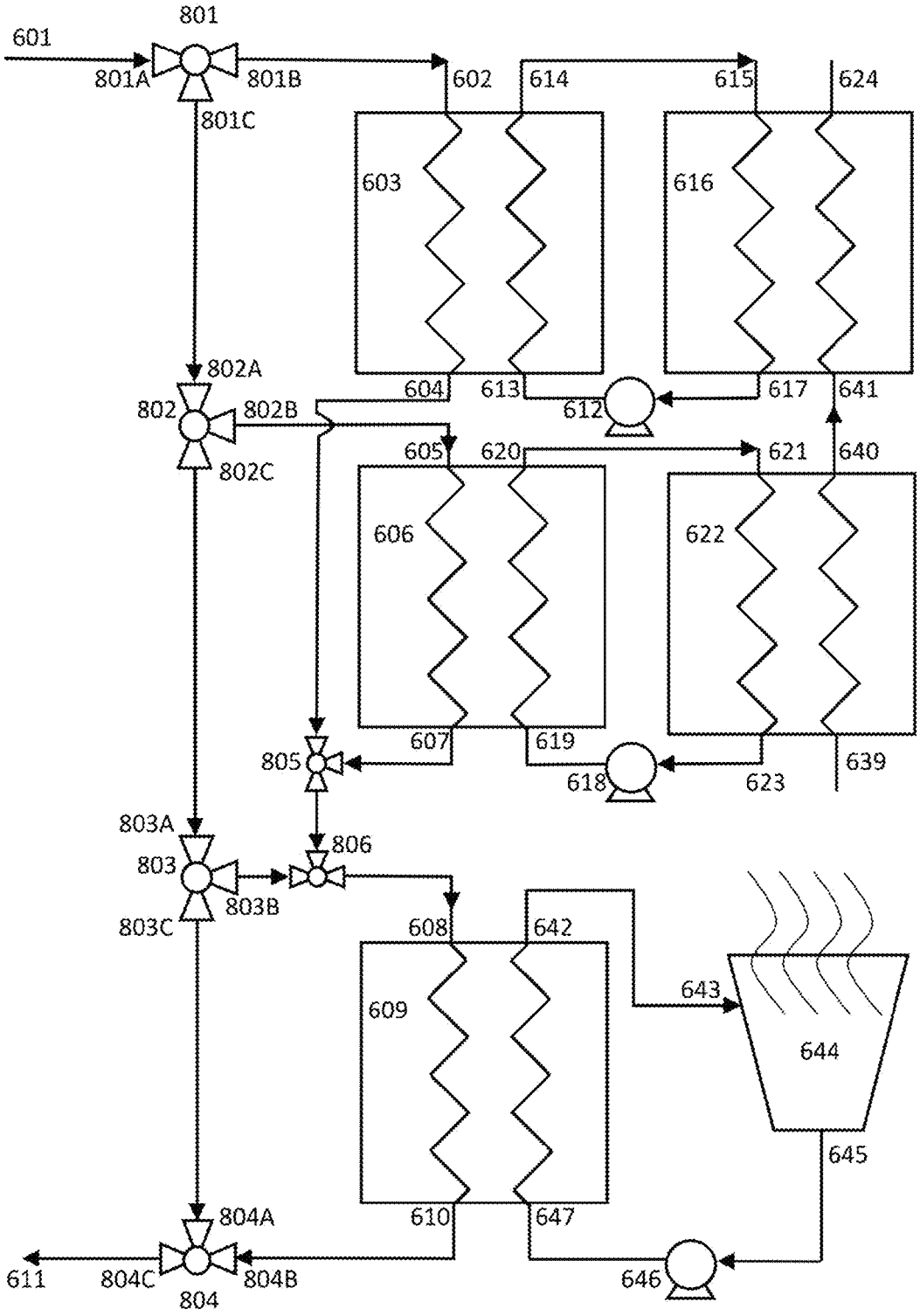
FIG. 8B is a block diagram of the embodiment of the invention depicted in FIG. 7B further comprising an alternate flow control valve scheme to permit controlled apportionment and distribution of the heat energy from the flow of a charge air heat stream.

FIG. 8B depicts the embodiment of FIG. 8A further comprising intermediate heat exchangers. Valve configuration and operation is identical to the embodiment of FIG. 8A with the added advantages in certain circumstances realized by the use of intermediate heat exchangers previously presented.

In addition to providing precise control over the portioning, distribution, and communication of heat energy from a heat stream, the flow control valves are also operative to control system pressures via restriction of mass flow rates. For example, with respect to the embodiment of FIG. 8B, the pressure at heat source input 602 of intermediate heat exchanger 603 is significantly determined by the settings of both valve outputs 801B and 801C. For a given setting of valve output 801B and a given heat stream input mass flow rate at valve input 801A, the mass flow rate delivered to heat source input 602 of heat exchanger 603 is also determined by the setting of valve output 801C. Closing valve output 801C would impose the entire mass flow and pressure at valve input 801A upon heat source input 602. Likewise, opening valve output 801C may significantly diminish the mass flow and pressure at heat source input 602 to the point that insufficient heat energy would be delivered to the ORC system for continued operation. Further, restricting the output flow from heat source output 604 at valve 805 would result in a significant increase in pressure within heat exchanger 603 that may lead to system failure or catastrophic failure of one or more individual components. It should be appreciated that the flow control valves enable control of all system operating parameters and that the methods associated with their configuration is an essential novel element of the invention described herein. As disclosed elsewhere herein with respect to jacket water distribution subsystem 210, the numerous valves in the other embodiments are also preferably controlled, and their status monitored, by a suitable microprocessor-based control subsystem (not shown) such as the DirectLogic series of programmable logic controllers (PLCs) available from Automation Direct of Cumming, Ga.

While the embodiments presented in FIGS. 6A through 8B have disclosed a heat stream as that of a compressed high temperature charge air heat stream, a single ORC system comprising multiple heat exchangers, and one supplemental condensing and cooling system, a person of ordinary skill in the art will immediately recognize and appreciate any number of related embodiments enabled by this disclosure. For example and not by way of limitation or exclusion of any other embodiments not specifically mentioned herein, heat stream 601 may comprise any other suitable source of heat conveyed via any suitable medium. More than one ORC system may be provided heat energy from a single heat stream, particularly a charge air heat stream from the turbocharger associated with a large industrial internal combustion engine. While the heat exchangers depicted in said embodiments are disclosed to be components of one or more ORC systems, portioned heat energy obtained from a heat stream according to the various configurations disclosed herein may be applied to heat exchangers operative for non-ORC purposes in addition to, or in lieu of, use in one or more ORC systems.

Figure 9:
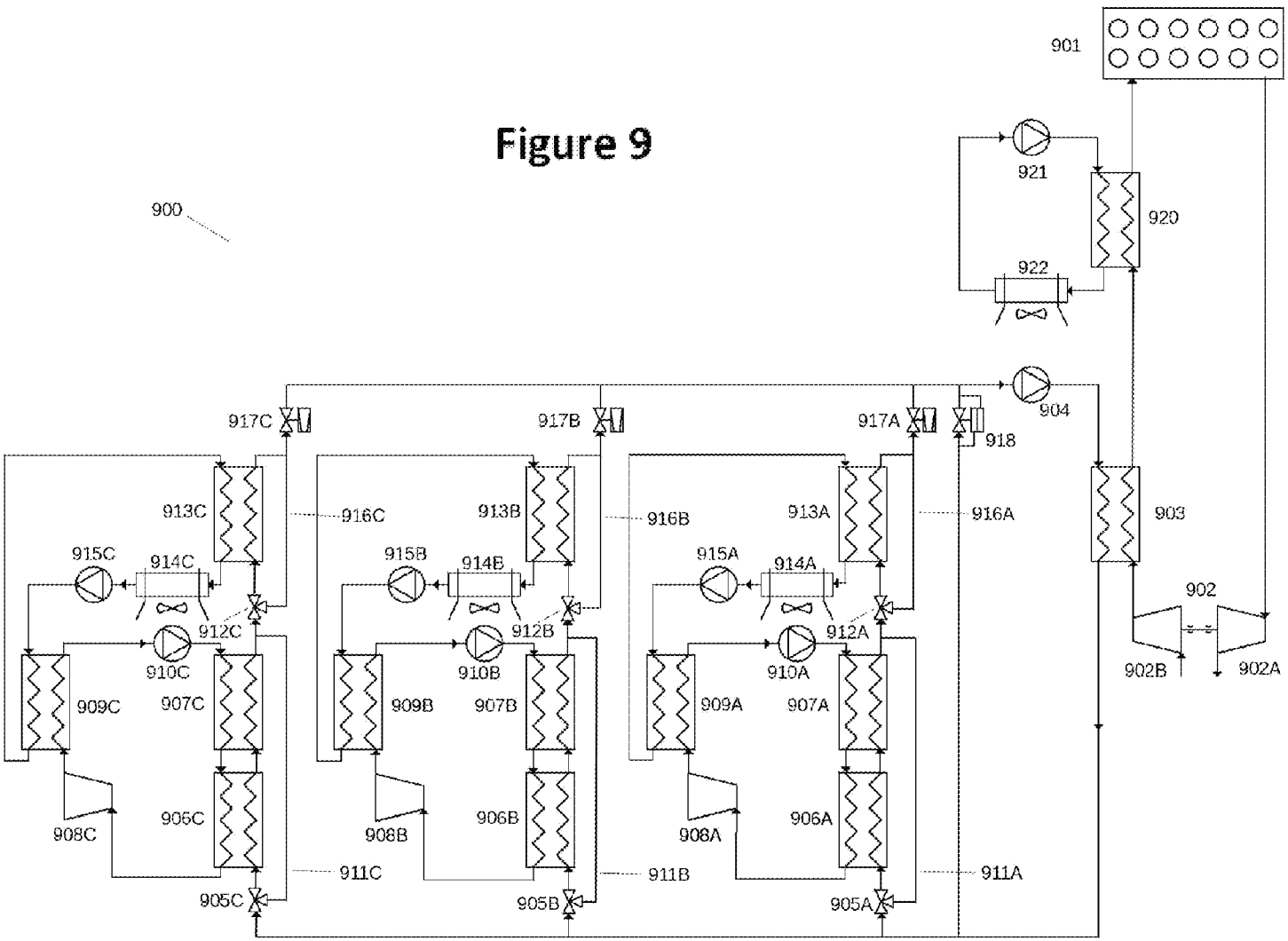
FIG. 9 is a block diagram of one embodiment of the invention comprising a single intermediate heat exchanger with multiple ORC systems and flow control valves operative to permit controlled apportionment and distribution of the heat energy from the flow of a charge air heat stream between ORC systems and the individual heat exchangers therein.

The embodiment depicted in FIG. 9 depicts a charge air cooling system suitable for use with a single engine requiring multiple ORC system to consume sufficient heat energy from the charge air heat stream to provide a compressed air feed to the engine at the desired temperature. System 900 comprises a single engine 901, which in some embodiments may be a two stroke engine producing in excess of 40 MW output power. Turbocharger 902 comprises a first turbine or other rotating machine 902A driven by the exhaust gas of the engine mechanically coupled to a second turbine, compressor, or other rotating machine 902B that receives ambient intake air and provides a charge air feed with the necessary degree of compression while increasing the temperature of the compressed charge air stream to a temperature in excess of that preferred by the engine. The charge air feed therefore comprises the heat stream from which heat will be extracted and, to the greatest degree possible, converted into useful mechanical or electrical energy.

The charge air heat stream is fed to intermediate heat exchanger 903, within which the bulk of the excess heat energy in the charge air feed is communicated via counterflow to a heat transfer medium of any suitable type know in the art. Said heat transfer medium circulates within a closed loop system under pressure supplied by pump 904. In this embodiment, three separate but identical ORC systems are depicted operating with controllable heat stream inputs essentially in a parallel heat energy receiving configuration, but such a system may comprise any number of ORC systems necessary or desired to consume up to all of the heat energy required to be extracted from the charge air heat stream. For the purpose of the following description, reference will often be made to elements only by their base element descriptors since each of the three ORC systems is identically configured. For example, the three ORC systems each comprise a single expander bearing a base element descriptor of 908 but individually identified in FIG. 9 as expander 908A, expander 908B, and expander 908C. Reference to "expanders 908" is intended to apply to each expander 908A, 908B, and 908C identically without distinction or difference.

Pump 904 provides sufficient motive force to provide flow of the heat transfer medium throughout the system beginning with heat exchanger 903. After passing through said heat exchanger and receiving heat energy communicated from the charge air heat stream, heated heat transfer medium is delivered to flow control valves 905 in heat transfer medium communication with ORC heat exchangers 906 and 907 in sequence. Valves 905 are controllably configured to accept a portion of the heat transfer medium as desired and directed by the system operator. The passage of heated transfer medium through said ORC heat exchangers communicates the heat energy obtained from the charge air feed to the counterflowing ORC working fluid in the heat exchangers, which fluid is then communicated to expanders 908 for expansion. Mechanical energy is produced by expansion of the ORC working fluid and said energy is utilized to provide useful work, such as driving at least one of any of an electric power generator, a prime mover, a pump, a combustion engine, a fan, a turbine, or a compressor (not shown). In the case of an electrical power generator, the electric power may be coupled to a commercial power grid or used independently for any beneficial purpose, including powering other systems or devices associated with engine 901 or elsewhere within system 900.

Following expansion, the ORC working fluid is communicated to condensers 909 for cooling sufficient to return said working fluid to a sufficiently liquid state to permit repressurization by pumps 910.

Having passed through ORC heat exchangers 906 and 907, the portions of heat transfer medium allocated by valves 905 to each of the separate ORC systems is now communicated to condensing and cooling systems via heat exchangers 913 for removal of any additional undesired excess heat energy not consumed by ORC heat exchangers 906 and 907. Heat exchangers 913 function as condensers and operate in separate closed loop circuits with ORC condensers 909, radiators 914, pumps 915, and a separate secondary heat transfer medium. As described elsewhere, the supplemental condensing and cooling systems are preferably configured to consume any residual heat present in the portion of heated transfer medium not previously consumed by the ORC system and to provide excess heat consumption capacity when needed.

The outputs of heat exchangers are communicated to valves 917 in flow communication with the input of pumps 904. In one embodiment, valves 917 are volume flow regulator valves configured to operate based on the pressure drop across the valves.

Valves 905 and 912 are configured and operative to control the flow of heat transfer medium through and across heat exchangers 906, 907, and 913. In addition to regulating the flow as desired by the system operator, they are also configured to provide heat transfer medium bypass across the heat exchangers. Valves 905 are operative to bypass all or a portion of the heat transfer medium across ORC heat exchangers 906 and 907 via bypass lines 911, while valves 912 are operative to bypass all or a portion of the heat transfer medium across supplemental heat exchangers 913 via bypass lines 916. These bypasses provide additional flow control capability and may also be utilized during system start-up and shutdown. In addition, valve 918 provides the ability to bypass a portion or all of the flow of heat transfer medium across all of the ORC systems when necessary or advisable. In some embodiments, valve 918 may be a differential pressure regulator such as the Series 42 self-operated Differential Pressure and Flow Regulators manufactured and sold by Samson Controls, Inc. Said device may be configured to prevent transient pressure spikes and to provide a degree of independence between the combined flow of heat transfer medium through the ORC systems and the flow through intermediate heat exchanger 903, particularly when the mass flow required through intermediate heat exchanger 903 exceeds the flow that may be accommodated by available ORC systems.

Following passage through intermediate heat exchanger 903, the charge air heat stream is communicated to a secondary condensing and cooling system comprising heat exchanger 920, radiator 922, and pump 921. As previously disclosed, radiator 922 may comprise any known type of apparatus or device suitable for the rejection of heat from the charge air heat stream, including but not limited to forced air or liquid cooled radiators. In some embodiments, the secondary condensing and cooling system may comprise a closed loop circuit with a separate heat transfer medium circulating therein.

Following passage through the secondary condensing and cooling system, the charge air feed is now at a temperature suitable for use by the engine and is communicated thereto.

Figure 10:
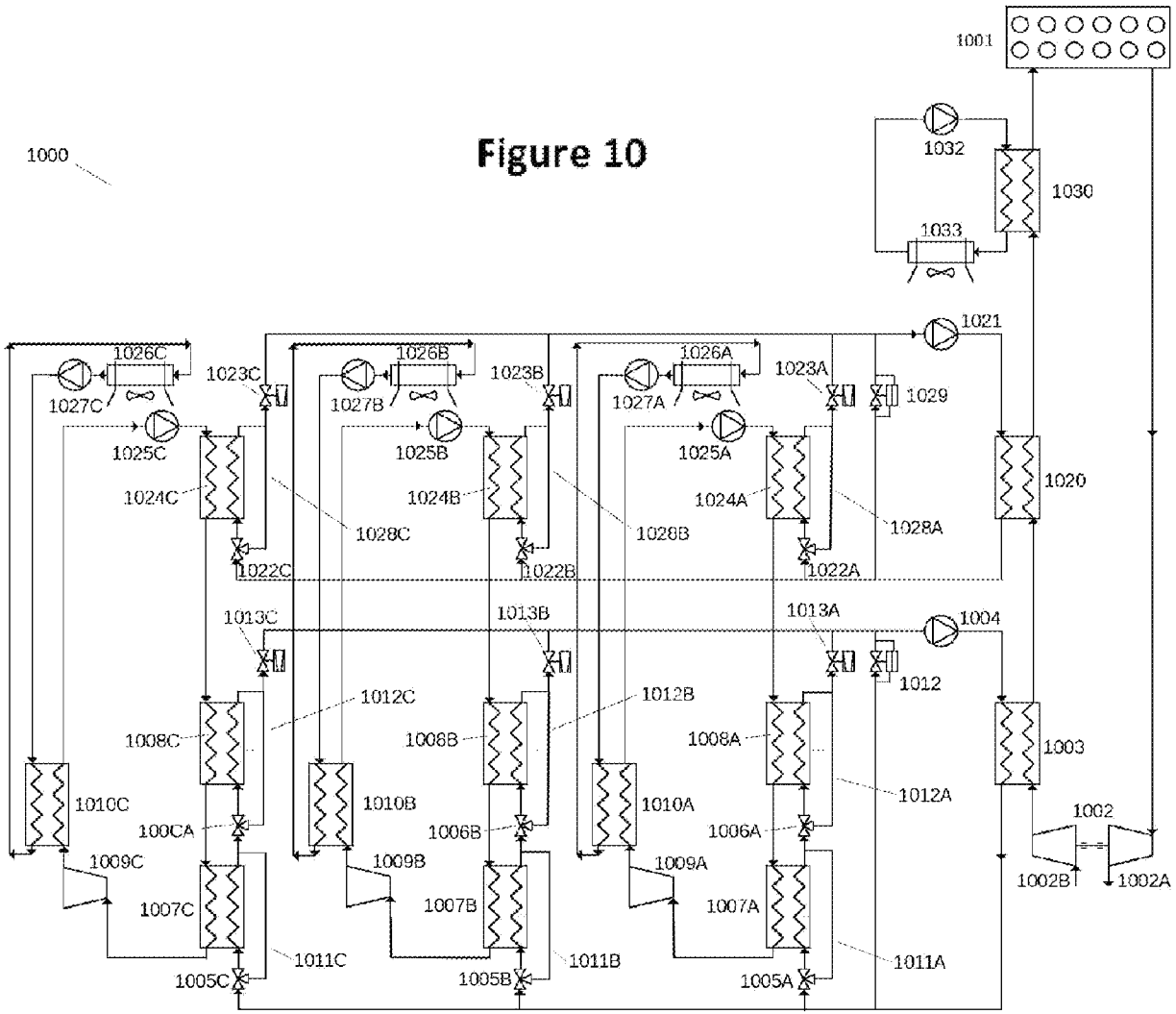
FIG. 10 is a block diagram of one embodiment of the invention comprising dual intermediate heat exchangers with multiple ORC systems and flow control valves operative to permit controlled apportionment and distribution of the heat energy from the flow of a charge air heat stream between ORC systems and the individual heat exchangers therein.

FIG. 10 depicts an embodiment comprising more than one intermediate heat exchanger operating at different temperatures and configured to transfer heat energy from the charge air feed to multiple ORC systems for conversion into mechanical or electrical power. System 1000 comprises a single engine 1001 and associated turbocharger 1002 comprises a first turbine or other rotating machine 1002A driven by the exhaust gas of the engine mechanically coupled to a second turbine, compressor, or other rotating machine 1002B that receives ambient intake air and provides the charge air feed as in the previous embodiment.

The charge air heat stream is fed to high temperature intermediate heat exchanger 1003, within which the bulk of the excess heat energy in the charge air feed is communicated via counterflow to a heat transfer medium of any suitable type know in the art. Said heat transfer medium circulates within a high temperature closed loop system under pressure supplied by pump 1004. As before, the depiction of this embodiment comprises three separate, identical ORC systems but is easily extensible to comprise any number of ORC system necessary or desired to consume up to all of the heat energy required to be extracted from the charge air heat stream as will be exemplified below.

Pump 1004 provides sufficient motive force to provide flow of the heat transfer medium throughout the high temperature portion of the system beginning with heat exchanger 1003. After passing through said heat exchanger and receiving heat energy communicated from the charge air heat stream, heated heat transfer medium is delivered to flow control valves 1005 in heat transfer medium communication with ORC heat exchangers 1007 and 1008 sequentially. Valves 1005 are controllably configured to accept a portion of the heat transfer medium as desired and directed by the system operator. The passage of heated transfer medium through said ORC heat exchangers communicates the heat energy obtained from the charge air feed to the counterflowing ORC working fluid in said heat exchangers, which fluid is then communicated to expanders 1009 for expansion. Mechanical energy is produced by expansion of the ORC working fluid and said energy is utilized to provide useful work, such as driving at least one of any of an electric power generator, a prime mover, a pump, a combustion engine, a fan, a turbine, or a compressor (not shown). In the case of an electrical power generator, the electric power may be coupled to a commercial power grid or used independently for any beneficial purpose, including powering other systems or devices associated with engine 1001 or elsewhere within system 1000.

Following expansion, the ORC working fluid is communicated to condensers 1010 for cooling sufficient to return said working fluid to a sufficiently liquid state to permit repressurization by pumps 1025. The working fluid outputs of condensers 1010 are in working fluid sending communication with radiators 1026 and pumps 1027 through which a separate heat transfer media may circulate.

Having passed through ORC heat exchangers 1007 and 1008, the portion of heat transfer medium apportioned by valves 1005 now passes through valves 1013 for communication to the input of pump 1004 for repressurization. In one embodiment, valves 1013 are volume flow regulator valves configured to operate based on the pressure drop across the valves.

Valves 1005 and 1006 are configured and operative to control the flow of heat transfer medium through and across heat exchangers 1007 and 1008. In addition to regulating the flow as desired by the system operator, they are also configured to provide heat transfer medium bypass across the heat exchangers. Valves 1005 are operative to bypass all or a portion of the heat transfer medium across ORC heat exchangers 1007 via bypass lines 1011, while valves 1006 are operative to bypass all or a portion of the heat transfer medium across ORC heat exchangers 1008 via bypass lines 1012. These bypasses provide additional flow control capability and may also be utilized during system start-up and shutdown. In addition, valve 1012 provides the ability to bypass all or a portion of the heat transfer medium in the high temperature portions across of all of the ORC systems when necessary or advisable. In some embodiments, valve 1012 may be a differential pressure regulator such as the Series 42 self-operated Differential Pressure and Flow Regulators manufactured and sold by Samson Controls, Inc. Said regulator valves may be configured to prevent transient pressure spikes and to provide a degree of independence between the combined flow of heat transfer medium through the ORC systems and the flow through intermediate heat exchanger 1003, particularly when the mass flow required through intermediate heat exchanger 1003 exceeds the flow that may be accommodated by available ORC systems.

Following passage through high temperature intermediate heat exchanger 1003, the charge air heat stream is communicated to low temperature intermediate heat exchanger 1020. As a substantial portion of the heat energy has been removed from the charge air feed during passage through high temperature heat exchanger 1003, the temperature of the feed is now significantly lower than initially. Pump 1021 provides sufficient motive force to provide flow of heat transfer medium throughout the low temperature portion of the system beginning with heat exchanger 1020. After passing through said heat exchanger and receiving heat energy communicated from the charge air heat stream, heated heat transfer medium is delivered to flow control valves 1022 in heat transfer medium communication with ORC heat exchangers 1024. Valves 1022 are controllably configured to accept a portion of the heat transfer medium as desired and directed by the system operator. The passage of heated transfer medium through said ORC heat exchangers communicates the heat energy obtained from the charge air feed to the counterflowing ORC working fluid in the heat exchangers, which is then communicated to the inputs of ORC heat exchangers 1008 in the high temperature portion of the system. In this manner, the low temperature portion of the system provides pre-heating of the ORC working fluid prior to communication of said fluid to the high temperature portion of the system.

The outputs of heat exchangers 1024 are communicated to valves 1023 in flow communication with the input of pumps 1021. In one embodiment, valves 1023 are volume flow regulator valves configured to operate based on the pressure drop across the valves.

Valves 1022 are configured and operative to control the flow of heat transfer medium through and across heat exchangers 1024. In addition to regulating the flow as desired by the system operator, they are also configured to provide heat transfer medium bypass across said heat exchangers. Valves 1022 are operative to bypass all or a portion of the heat transfer medium across ORC heat exchangers 1024 via bypass lines 1028. These bypasses provide additional flow control capability and may also be utilized during system start-up and shutdown.

In addition, valve 1029 provides the ability to bypass all or a portion of the heat transfer medium in the low temperature portion of the system across of all of the ORC systems when necessary or advisable. In some embodiments, valve 1029 may be a differential pressure regulator such as the Series 42 self-operated Differential Pressure and Flow Regulators manufactured and sold by Samson Controls, Inc. Said regulator valve may be configured to prevent transient pressure spikes and to provide a degree of independence between the combined flow of heat transfer medium through the ORC systems and the flow through low temperature intermediate heat exchanger 1020, particularly when the mass flow required through said heat exchanger exceeds the flow that may be accommodated by available ORC systems.

Following passage through low temperature intermediate heat exchanger 1020, the charge air heat stream is communicated to a secondary condensing and cooling system comprising heat exchanger 1030, radiator 1033, and pump 1032. As previously disclosed, radiator 1033 may comprise any know type of apparatus or device suitable for the rejection of heat from the charge air heat stream, including but not limited to forced air or liquid cooled radiators. In some embodiments, the secondary condensing and cooling system may comprise a closed loop circuit with a separate heat transfer medium circulating therein.

Following passage through the secondary condensing and cooling system, the charge air feed is now at a temperature suitable for use by the engine and is communicated thereto.

In one non-limiting exemplary embodiment of the system depicted in FIG. 10, the charge air feed associated with a turbocharged MAN K80MC-S9 engine comprises the heat stream provided by turbocharger 1002B to ORC heat exchangers 1003 and 1020 and secondary condensing and cooling system heat exchanger 1030 sequentially. Given an ambient inlet air temperature of 37° C., the turbocharger will produce a charge air feed with an approximate mass flow rate of 100 kg/s at a approximate temperature of 210° C. The desired engine air inlet temperature is specified by the manufacturer to be 44° C., requiring a reduction in temperature of 166° C. by extracting heat energy at the approximate rate of 17 MW (17 MJ/s) from the heat stream. Extracting energy from the charge air heat stream via the embodiment of FIG. 10 will provide significant mechanical power to perform useful work or to generate electrical power.

As described above, a first portion of heat energy is extracted via high temperature heat exchanger 1003 for communication to the working fluid of multiple ORC systems via dual heat exchangers 1007 and 1008. Although two heat exchangers are depicted, it should be appreciated that one heat exchanger or more than two heat exchangers may be utilized to accomplish the transfer of heat energy from the heat transfer medium circulating in the high temperature portion of the system. In this exemplary embodiment, said heat transfer medium is water.

The temperature at the charge air heat stream input to heat exchanger 1003 is approximately 210° C., and after extracting a portion of the heat energy at the approximate rate of 8.3 MW and communicating it to the heat transfer medium therein, it exits said heat exchanger at an approximate temperature of 128° C. The portion of extracted heat energy communicated to the water heat transfer medium raises the temperature of the circulating water to approximately 122° C. A portion of the heat energy in said heat transfer medium is then communicated to the ORC working fluid in each of the multiple ORC systems via heat exchangers 1007 and 1008.

The partially heat-depleted charge air heat stream is communicated to low temperature intermediate heat exchanger 1020 at an approximate input temperature of 128° C., where additional heat energy is extracted at the approximate rate of 3.7 MW prior to expulsion of the further heat depleted charge air heat stream at an approximate temperature of 93° C. The temperature of the heat transfer medium flowing in the low temperature portion of the system is raised to an approximate temperature of 87° C. and applied to ORC heat exchangers 1024 to preheat the ORC working fluid prior to its communication to ORC heat exchangers 1008 and 1007.

Finally, the charge air heat stream is communicated to secondary condensing and cooling system heat exchanger 1030 at an approximate input temperature of 93° C., wherein additional heat energy is extracted at the rate of approximately 5.0 MW and dissipated by radiator 1033. It should be appreciated that heat exchanger 1030 and radiator 1033 may each comprise more than one physical apparatus of identical or different types. When expelled from heat exchanger 1030, the charge air stream is now approximately at the required temperature of 44° C. for injection into engine 1001, having transferred heat energy at the approximate total rate of 17 MW to the three charge air heat exchangers described above.

The heat energy transferred to the multiple ORC systems via the high temperature and low temperature portions of the system is used to heat ORC working fluid for expansion in expanders 1009, thereby generating mechanical power. Given the temperature of the water heat transfer medium flowing in the each of the high and low temperature portions of the system, a single ORC system of the type manufactured and sold by ElectraTherm, Inc. of Reno, Nev. may be expected to consume heat energy at the approximate combined rate of 1.25 MW. Given the total rate of heat energy consumption of the charge air heat exchangers 1003 and 1020 of approximately 12.0 MW, it can be seen that a total of ten identical ORC systems would be required for full consumption of all charge air heat in this embodiment. As previously described, the system depicted in FIG. 10 is easily extensible to any number of ORC systems, including the ten required in this example, from the three shown for purposes of enablement of the written description.

If the mechanical power developed via expansion of each of the expanders 1009 is coupled to electrical generators, each system would provide approximately 93 kW (0.093 MW) of electrical power for a combined electrical power output of 930 kW (0.93 MW). As such, the overall efficiency of the combined charge air cooling and heat energy recovery system is approximately 7.8%. In practice, additional heat losses not considered in the above example would reduce the realized efficiency slightly, but the fact that close to one megawatt of power may be generated from a charge air stream, previously classified as a waste heat byproduct of the necessary charge air cooling, represents a significant advantage over known technologies.

The description of this invention is intended to be enabling and not limiting. It will be evident to those skilled in the art that numerous combinations of the embodiments described above may be implemented together as well as separately, and all such combinations constitute embodiments effectively described herein.

What is claimed is:

1. A heat energy distribution system comprising:

A. a source of heat energy comprising a flow of compressed charge air of elevated temperature and density produced by and communicated from a turbocharger for use in an internal combustion engine;

B. more than one heat transfer flow control valve in heat energy receiving communication with said source of heat energy; and C. more than one primary heat exchanger, each said primary heat exchanger in heat energy receiving communication with at least one of said more than one heat transfer flow control valve;

wherein each of said more than one heat transfer flow control valve are operative to portion, distribute, and communicate a controllable portion of heat energy from the source of heat energy to at least one of the more than one primary heat exchangers.

2. The system of claim 1 wherein each of said controllable portions of heat energy portioned, distributed, and communicated by each of said more than one heat transfer flow control valve may comprise all, some, or none of the heat energy communicated thereto by said source of heat energy.

3. The system of claim 2 further comprising one or more intermediate heat exchanger(s) disposed between said source of heat energy and said more than one primary heat exchanger such that heat energy is communicated from said source of heat energy to each of said more than one primary heat exchanger via at least one of said one or more intermediate heat exchanger(s).

4. The system of claim 2 further comprising at least one organic Rankine cycle (ORC) system comprising an ORC working fluid, at least one expander, at least one condenser, and at least one working fluid pump, wherein at least one of said more than one primary heat exchanger is configured to communicate heat energy to said ORC working fluid for expansion in said at least one expander to generate mechanical power.

5. The system of claim 4 further comprising at least one electrical power generator and wherein at least a portion of said generated mechanical power is communicated to said at least one electrical power generator.

6. The system of claim 4 comprising more than one ORC system and wherein at least one of said more than one primary heat exchanger is configured to communicate heat energy from the source of heat to two or more of said more than one ORC systems.

7. The system of claim 4 wherein at least one controllable portion of heat energy is communicated from the source of heat energy to at least one of said more than one primary heat exchanger not configured to communicate heat energy to any of the at least one ORC system.

8. A method of controlling distribution of heat energy, the method comprising:

A. receiving a source of heat energy comprising a flow of compressed charge air of elevated temperature and density produced by and communicated from a turbocharger for use in an internal combustion engine;

B. providing more than one heat transfer flow control valve in heat energy receiving communication with said source of heat energy;

C. portioning, distributing, and communicating a controllable portion of heat energy from said source of heat energy via said more than one heat transfer flow control valve, thereby creating and providing more than one controllable portion of heat energy.

9. The system of claim 1 wherein all of said more than one heat transfer flow control valve are in direct heat energy receiving communication with said source of heat energy.

10. The system of claim 8 wherein each of said more than one controllable portion of heat energy portioned, distributed, and communicated by each of said more than one heat transfer flow control valve may comprise all, some, or none of the heat energy communicated thereto by said source of heat energy.

11. The method of claim 10 further comprising more than one heat exchanger wherein said more than one controllable portion of heat energy are communicated to at least one of said more than one heat exchanger.

12. The method of claim 11 wherein at least one of said more than one controllable portion of heat energy communicated to at least one of said more than one heat exchanger is subsequently communicated to another of said more than one heat exchanger.

13. The method of claim 11 further comprising the additional steps of:

A. providing one or more organic Rankine cycle (ORC) system(s) each comprising an ORC working fluid, at least one expander, at least one condenser, and at least one working fluid pump;

B. creating heated ORC working fluid by communicating heat energy from at least one of said more than one heat exchanger to said ORC working fluid of at least one of said one or more ORC system(s); and C. expanding said heated ORC working fluid in said at least one expander of said at least one of said one or more ORC system(s) to generate mechanical power.

14. The method of claim 13 wherein at least one of said one or more ORC system(s) further comprise(s) an electrical power generator in mechanical power receiving communication with said expander, and said method further comprises an additional step of utilizing at least a portion of said mechanical power to generate electrical power via said electrical power generator.

15. The method of claim 13 wherein at least one of said more than one controllable portion of heat energy is communicated to at least one of said more than one heat exchanger not configured to communicate heat energy to any of said one or more ORC system(s).

16. The method of claim 8 wherein all of said more than one heat transfer flow control valve in heat energy receiving communication with said source of heat energy are in direct heat energy receiving communication with said source of heat energy.

17. A method for recovering power from a compressed charge air stream, the method comprising:

A. providing a source of heat energy comprising a flow of compressed charge air of elevated temperature and density produced by and communicated from a turbocharger for use in an internal combustion engine;

B. providing more than one heat transfer flow control valve in compressed charge air receiving communication with said source of heat energy;

C. providing more than one heat exchanger, each of said more than one heat exchanger in compressed charge air receiving communication with at least one of said more than one heat transfer flow control valve;

D. portioning, distributing, and communicating a controllable portion of said compressed charge air from said source of heat to any of said more than one heat exchanger via adjustment of any of said more than one heat transfer flow control valve;

E. providing at least one organic Rankine cycle (ORC) system comprising an ORC working fluid, at least one expander, at least one condenser, and at least one working fluid pump, said at least one ORC system in direct or indirect heat energy receiving communication with at least one of said more than one heat exchanger;

F. directly or indirectly communicating heat energy from at least one of said more than one heat exchanger to said ORC working fluid to create heated ORC working fluid; and G. expanding said heated ORC working fluid in said at least one expander to generate mechanical power.

18. The system of claim 17 wherein any of said controllable portions of heated compressed air portioned, distributed, and communicated by each of said more than one heat transfer flow control valve may comprise all, some, or none of the compressed charge air communicated thereto by said source of heat energy.

19. The method of claim 18 wherein said at least one ORC system further comprises an electrical generator in mechanical power receiving communication with at least one of said at least one expander and said method further comprises an additional step of utilizing at least a portion of said mechanical power to generate electrical power.

20. The method of claim 18 wherein at least one of said controllable portions of heated compressed air is communicated to at least one of said more than one heat exchangers not communicating heat energy to said ORC working fluid.

21. The system of claim 17 wherein all of said more than one heat transfer flow control valve are in direct heated compressed air receiving communication with said source of heat energy.

* * * * *